US009909201B2

(12) United States Patent
Prest et al.

(10) Patent No.: US 9,909,201 B2
(45) Date of Patent: Mar. 6, 2018

(54) CONSUMER ELECTRONICS MACHINED HOUSING USING COATING THAT EXHIBIT METAMORPHIC TRANSFORMATION

(75) Inventors: Christopher D. Prest, San Francisco, CA (US); Matthew S. Scott, Campbell, CA (US); Stephen P. Zadesky, Portola Valley, CA (US); Dermot J. Stratton, San Francisco, CA (US); Joseph C. Poole, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 273 days.

(21) Appl. No.: 13/541,696

(22) Filed: Jul. 4, 2012

(65) Prior Publication Data

US 2014/0009872 A1 Jan. 9, 2014

(51) Int. Cl.

| | |
|---|---|
| ***C22C 45/00*** | (2006.01) |
| ***C22C 38/00*** | (2006.01) |
| ***C23C 4/18*** | (2006.01) |
| ***C23C 24/04*** | (2006.01) |
| ***C23C 4/067*** | (2016.01) |

(Continued)

(52) U.S. Cl.

CPC ..... *C23C 4/18* (2013.01); *C22C 19/07* (2013.01); *C22C 38/18* (2013.01); *C22C 38/24* (2013.01); *C22C 38/28* (2013.01); *C22C 38/32* (2013.01); *C22C 38/34* (2013.01); *C22C 38/38* (2013.01); *C22C 38/42* (2013.01); *C22C 38/44* (2013.01); *C22C 38/50* (2013.01); *C22C 38/54* (2013.01); *C22C 45/02* (2013.01); *C23C 4/067* (2016.01); *C23C 24/04* (2013.01); *B22F 9/08* (2013.01); *C22C 1/045* (2013.01); *C22C 1/0458* (2013.01); *C22C 1/0466* (2013.01);

(Continued)

(58) Field of Classification Search

CPC ..... C22C 45/008; C22C 45/02; C22C 45/04
USPC ..... 428/681–685; 420/8–129
See application file for complete search history.

(56) References Cited

U.S. PATENT DOCUMENTS

| | | | | |
|---|---|---|---|---|
| 4,564,396 | A | 1/1986 | Johnson | |
| 4,725,512 | A * | 2/1988 | Scruggs ..... | B23K 35/30 148/403 |

(Continued)

FOREIGN PATENT DOCUMENTS

| | | |
|---|---|---|
| JP | 2001-303218 | 10/2001 |
| WO | 2011/116350 | 9/2011 |

OTHER PUBLICATIONS

International Search Report and Written Opinion, dated Dec. 2, 2013, PCT/ISA/210, PCT/ISA/220, PCT/ISA/237, total of 11 pages.

(Continued)

*Primary Examiner* — Humera N Sheikh
*Assistant Examiner* — Xiaobei Wang
(74) *Attorney, Agent, or Firm* — Brownstein Hyatt Farber Schreck, LLP

(57) ABSTRACT

Various embodiments provide materials, parts, and methods useful for electronic devices. One embodiment includes providing a coating on at least one surface of a substrate, increasing an amorphicity of the coating, and incorporating the substrate including the coating having increased amorphicity into an electronic device. Another embodiment relates to frictionally transforming a coating from crystalline into amorphous to form a metamorphically transformed coating for an electronic device. Another embodiment relates to an electronic device part having a metamorphically transformed coating disposed on at least one surface thereof.

20 Claims, 6 Drawing Sheets

(51) Int. Cl.

| | |
|---|---|
| ***C22C 19/07*** | (2006.01) |
| ***C22C 38/18*** | (2006.01) |
| ***C22C 38/24*** | (2006.01) |
| ***C22C 38/28*** | (2006.01) |
| ***C22C 38/32*** | (2006.01) |
| ***C22C 38/34*** | (2006.01) |
| ***C22C 38/38*** | (2006.01) |
| ***C22C 38/42*** | (2006.01) |
| ***C22C 38/44*** | (2006.01) |
| ***C22C 38/50*** | (2006.01) |
| ***C22C 38/54*** | (2006.01) |
| ***C22C 45/02*** | (2006.01) |
| *B22F 9/08* | (2006.01) |
| *C22C 1/04* | (2006.01) |
| *C22C 32/00* | (2006.01) |
| *C22C 33/02* | (2006.01) |

(52) U.S. Cl.
CPC ..... *C22C 32/0047* (2013.01); *C22C 33/0278* (2013.01); *C22C 33/0285* (2013.01)

(56) References Cited

U.S. PATENT DOCUMENTS

| | | | |
|---|---|---|---|
| 4,965,139 | A | 10/1990 | Kabacoff |
| 5,288,344 | A | 2/1994 | Peker |
| 5,368,659 | A | 11/1994 | Peker |
| 5,618,359 | A | 4/1997 | Lin |
| 5,735,975 | A | 4/1998 | Lin |
| 6,325,868 | B1 | 12/2001 | Kim |
| 7,256,369 | B2 | 8/2007 | Seitz |
| 7,575,040 | B2 | 8/2009 | Johnson |
| 2007/0079907 | A1 | 4/2007 | Johnson |
| 2008/0118387 | A1 | 5/2008 | Demetriou |
| 2008/0135136 | A1 | 6/2008 | Demetriou |
| 2009/0162629 | A1 | 6/2009 | Demetriou |
| 2010/0084052 | A1 | 4/2010 | Farmer |
| 2010/0230012 | A1 | 9/2010 | Demetriou |
| 2010/0300148 | A1 | 12/2010 | Demetriou |
| 2011/0162795 | A1 | 7/2011 | Pham |

OTHER PUBLICATIONS

Zheng Zhou et al., "Formation and corrosion behavior of Fe-based amorphous metallic coatings prepared by detonation gun spraying", Transactions of Nonferrous Metals Society of China, vol. 19, Dec. 31, 2009, pp. 634-638.

Inoue et al., "Bulk amorphous alloys with high mechanical strength and good soft magnetic properties in Fe—Tm—B (TM=IV-VIII group transition metal) system", Appl. Phys. Lett., vol. 71, p. 464 (1997).

Shen et., "Bulk Glassy Co4Fe20Ta5.5B31.5 Alloy with High Glass-Forming Ability and Good Soft Magnetic Properties", Materials Transactions, vol. 42 No. 10 (2001) pp. 2136-2139.

* cited by examiner

CONSUMER ELECTRONICS MACHINED HOUSING USING COATING THAT EXHIBIT METAMORPHIC TRANSFORMATION

BACKGROUND

Numerous ferrous alloys (e.g., high strength steels) and non-ferrous alloys have been developed for use in heavy construction and machinery. Although these alloys provide a good combination of strength and toughness, they typically do not show adequate resistance to wear, erosion, and corrosion. Thus, they are not well-suited for use in applications in which the surfaces of these alloys are subjected to aggressive environment or abrasion. One approach to remedy this problem is to use a hard-facing material deposited onto the surface of an underlying structure/substrate to act as a protective layer. The underlying structure (e.g., steel substrate) provides the strength and structural integrity needed for the layer-substrate structure, and the hard-facing alloy protects the substrate against wear and abrasion in adverse environments. The hard-facing material also can protect the substrate against corrosion as well.

A wide-variety of hard-facing materials are known, including, for example, ceramic-containing compositions such as tungsten carbide/cobalt and purely metallic compositions. One problem encountered with most hard-facing material is that when applied by thermal spraying, the hard-facing deposit often contains porosity and has through-cracks that extend perpendicularly to the thickness direction of the coating. The porosity permits corrosive media to penetrate through the coating to reach the substrate and damage it by chemical corrosion or stress corrosion. The through-cracks can also lead to fracturing and spalling of the wear-resistant coating, thereby resulting in the abrasive or corrosive media reaching the underlying substrate and rapidly wearing out the underlying substrate.

SUMMARY

A proposed solution according to embodiments herein for electronic devices is to transform a coating on a substrate such as an electronic device part. The coating can be formed of a metamorphic transformable material capable of increasing amorphicity and/or transforming the coating into amorphous, upon heating, for example. In one embodiment, the transformed coating may be used in a machined housing of an electronic device. The transformed coating may be at least substantially amorphous.

Provided in one embodiment is a method of providing a coating on at least one surface of a substrate; increasing an amorphicity of the coating; and incorporating the substrate, including the coating having increased amorphicity, into an electronic device. In embodiments, the substrate is incorporated into the electronic device before the electronic device is sold or used.

Provided in one embodiment is a method of providing a coating on at least one surface of a substrate, the coating containing crystalline; frictionally transforming the coating from crystalline into amorphous to form a transformed coating; and incorporating the substrate comprising the transformed coating into an electronic device.

Provided in one embodiment is an electronic device. The electronic device may include one or more electronic device parts and a transformed coating disposed on at least one surface of the one or more electronic device parts. The transformed coating can be formed of a metamorphic transformable material capable of increasing amorphicity or transforming the coating into amorphous, upon frictional heating, for example.

DETAILED DESCRIPTION

Figure 1:
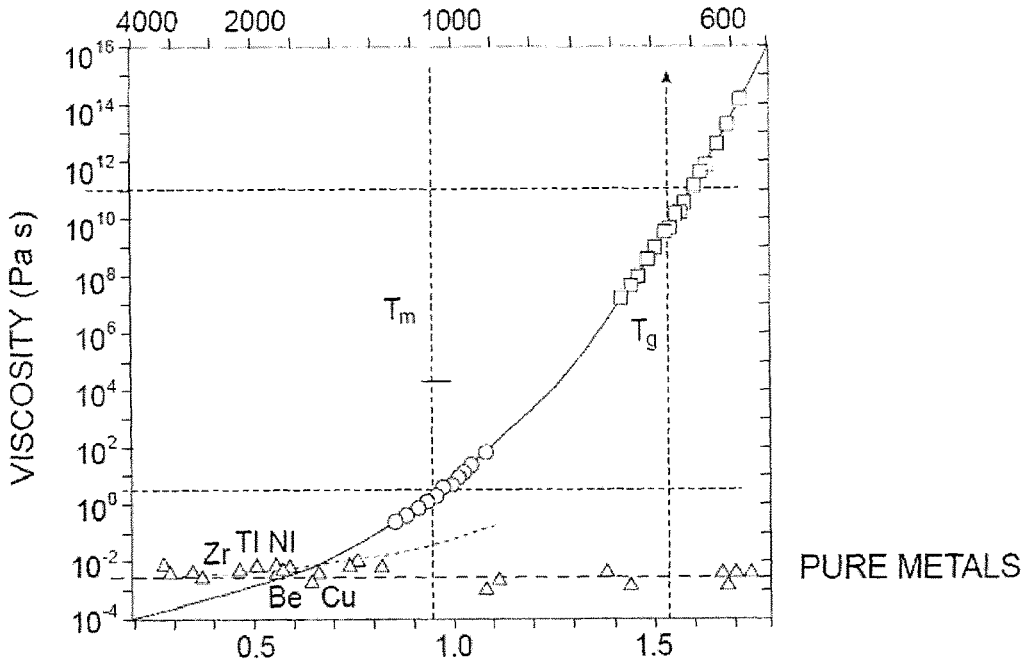
FIG. 1 provides a temperature-viscosity diagram of an exemplary bulk solidifying amorphous alloy.

All publications, patents, and patent applications cited in this Specification are hereby incorporated by reference in their entirety.

The articles "a" and "an" are used herein to refer to one or to more than one (i.e., to at least one) of the grammatical object of the article. By way of example, "a polymer resin" means one polymer resin or more than one polymer resin. Any ranges cited herein are inclusive. The terms "substantially" and "about" used throughout this Specification are used to describe and account for small fluctuations. For example, they can refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

A proposed solution according to embodiments herein for electronic devices is to transform a coating on a substrate such as an electronic device part. The coating can be formed of a metamorphic transformable material capable of increasing amorphicity and/or transforming the coating into amorphous, upon heating, for example. In one embodiment, the transformed coating may be used in a machined housing of an electronic device. The transformed coating may be at least substantially amorphous. In embodiments, the coating, non-transformed or transformed, may include, e.g., bulk-solidifying amorphous alloy or bulk metallic glasses (BMG) as described in this disclosure.

Metamorphic Transformation

The term "metamorphic transformation" refers to a change in a material due to metamorphism, which is the solid-state change in amorphicity of a pre-existing material due to changes in physical and chemical conditions, such as heat, pressure, and the introduction of chemically active fluids. Different forms of metamorphism include: contact (thermal) metamorphism occurring typically due to the temperature increase; hydrothermal metamorphism due to interaction of the material with a high-temperature fluid, for example, of a variable composition; shock metamorphism due to impact on the material, often characterized by high pressure conditions; and dynamic metamorphism due to strain in the material.

Metamorphic Transformable Material

The term "a metamorphic transformable material" refers to a material that undergoes metamorphic transformation to an amorphous state having a higher amorphicity, e.g., by local heating, frictional heating, thermoplastic transformation, abrasion, etc. A metamorphic transformable material may survive abrasive wear due to the already increased amorphicity and/or further increase of amorphicity on abrasion. The term "amorphous state" or "amorphous phase" refers to a state having amorphicity therein. Suitable frictionally transforming amorphous alloys may include from about 40 to about 75 weight percent of a first component selected from the group consisting of iron, cobalt, and combinations thereof; more than about 20 weight percent of a second component selected from the group consisting of chromium, molybdenum, tungsten, niobium, vanadium, and combinations of chromium, molybdenum, tungsten, niobium, vanadium, and titanium; and from about 2 to about 6 weight percent of a third component selected from the group consisting of boron, carbon, and combinations thereof.

Another suitable metamorphic transformable material may include from about 20 to about 35 percent chromium, from about 2 to about 5 percent boron, from about 1 to about 2.5 percent silicon, from 0 to about 0.5 percent carbon, from about 0.5 to about 2 percent manganese, and from about 0.2 to about 1.0 percent titanium, balance iron and incidental impurities. Other suitable metamorphic transformable materials may include a molybdenum-containing ferrous alloy powder composition that provides a wear-resistant and corrosion-resistant coating on a substrate. The alloy powder compositions of any of the metamorphic transformable materials can be manufactured by typical gas atomization using non-reactive gases.

The method of providing the coating involves coating a substrate with a metamorphic transformable material using a high velocity thermal spraying process. Applying metamorphic transformable materials using thermal spraying processes are known. These coatings typically are porous and do not always result in an efficient coating of the surface of the substrate. For example, the pores may be infiltrated with harmful and/or corrosive liquids and other materials which may cause weak points in the coating or even significant breaks in the surface that are further weakened when the material is frictionally transformed either during use or prior to use. The coatings also may not sufficiently adhere to the surface of the substrate. In addition, when the coatings are very thin, as is the case with coatings on small electronic devices and the like, the presence of large pores and defects and the problems caused thereby are further exacerbated.

The method of providing the coating of the preferred embodiments includes subjecting the coated substrate to additional heating. The additional heating preferably is at a temperature below the crystallization temperature of the metamorphic transformable material to prevent the material from losing its crystallinity and ability to frictionally transform, but also is above the glass transition temperature to allow the material to somewhat coalesce. While not intending on being bound by any theory of operation, the inventor believes that this additional heating provides a smoother surface with fewer or no pores, and more adequately adheres the coating to the surface of the substrate. After heating, the substrate and coating are cooled to provide a final coated product.

Powder-containing Composition

The term "powder-containing composition" or "powder composition" herein refers to any composition containing a powder therein. The term "powder" refers to a substance containing ground, pulverized, or otherwise finely dispersed solid particles.

Coating and Processing the Coating

The term "coating" refers to a covering, e.g., a layer of material, which is applied to the surface of an object, usually referred to as the "substrate." In one embodiment, at least one of the presently described compositions, including alloy powder compositions, can applied onto a substrate to provide a coating. In one embodiment, the coating consists essentially of the presently described compositions. In another embodiment, the coating consists of the presently described compositions. In embodiments, the coating can be a pre-existing coating, for example, a portion of an electronic device. Alternatively, the coating can be provided onto a substrate such as an electronic device part. In embodiments, the substrate can be of any type of suitable substrate, such as a metal substrate, a ceramic substrate, or a combination thereof. In another embodiment, the substrate can be a bulk-solidifying amorphous alloy.

The coating can include any of the alloy powder composition as described herein. In addition to the alloy powder composition, the coating can include additional elements or materials, such as those from a binder. The term "binder" refers to a material used to bind other materials. The coating can also include any additives intentionally added or incidental impurities. In one embodiment, the coating consists essentially of the alloy powder composition, such as consisting of the alloy powder compositions described above.

In embodiments, the coating can be formed of a material including an alloy. In one example, the alloy may include from about 40 to about 75 weight percent of a first component selected from the group consisting of iron, cobalt, and combinations thereof; more than about 20 weight percent of a second component selected from the group consisting of chromium, molybdenum, tungsten, niobium, vanadium, and combinations of chromium, molybdenum, tungsten, niobium, vanadium, and titanium; and from about 2 to about 6 weight percent of a third component selected from the group consisting of boron, carbon, and combinations thereof.

Another example of the alloy may include from about 20 to about 35 percent chromium; from about 2 to about 5 percent boron; from about 1 to about 2.5 percent silicon; from about 0 to about 0.5 percent carbon; from about 0.5 to about 2 percent manganese; from about 0.2 to about 1.0 percent titanium; and the balance iron and incidental impurities.

Non-limiting examples of the alloy may include an alloy represented by the formula $(Cr_aMo_bC_cB_d)Fe_{100-(a+b+c+d)}$, wherein a, b, c, d each independently represents a weight percentage, and wherein a is from about 22 to about 28, b is from about 14 to about 20, c is from about 2 to about 3, and d is from about 1.5 to about 2.

As disclosed herein, the provided coating can be further processed. The coating can be formed of metamorphic transformable materials. The coating can be, e.g., transformed, to provide a transformed coating, which has increased amorphicity and/or be more amorphous due to transformation from crystalline to amorphous as compared with the provided, non-transformed coating.

Figure 5:
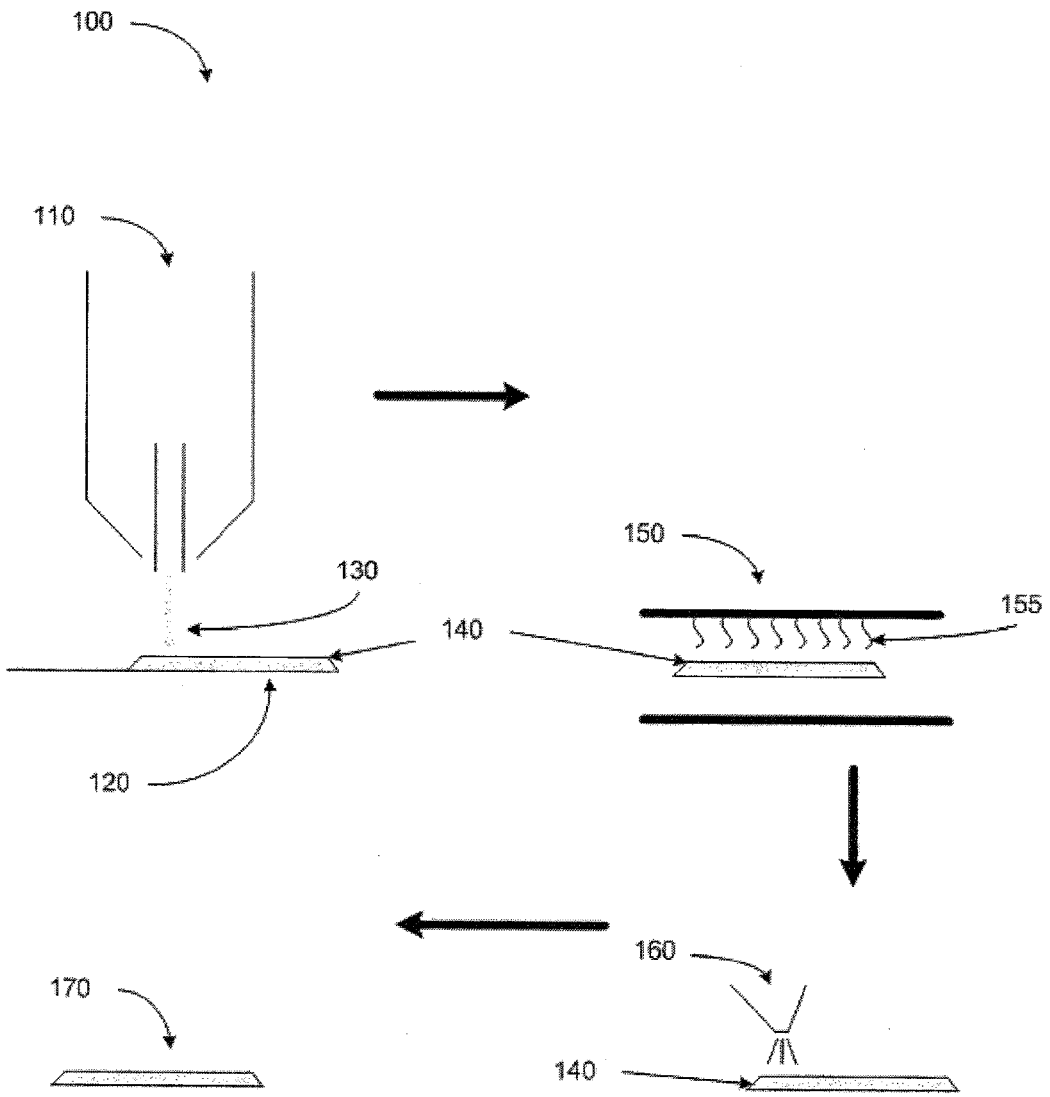
FIG. 5 shows a schematic diagram of a method in accordance with various embodiments of the present teachings.

Provided in one embodiment includes an exemplary method 300 as shown in FIG. 5. The method 300 include, for example, providing a coating on at least one surface of a substrate, e.g., see block 310; increasing an amorphicity of the coating, e.g., see block 320; and incorporating the substrate, including the coating having increased amorphicity, into an electronic device, e.g., see block 330. In embodiments, the substrate is incorporated into the electronic device before the electronic device is sold or used.

In embodiments, the coating may be provided having an amorphicity. The amorphicity may be zero or more than zero. Alternatively, the coating may be provided with or without crystalline. In one embodiment, the coating may be provided by, for example, depositing a precursor of a metamorphic transformable material on the at least one surface of the substrate; heating the substrate and heating the precursor to a temperature and for a period of time to sufficiently adhere the precursor to the at least one surface of the substrate; and producing the coating formed of the metamorphic transformable material on the at least one surface of the substrate.

In embodiments, the coating can be, for example, frictionally heated, locally heated, and/or thermoplastically treated to increase its amorphicity. In embodiments, the coating can be surface processed by, for example, grinding, polishing, lapping, abrading, and combinations thereof to increase its amorphicity. Such processes provide local heating that thermoplastically smoothens out a surface of the coating to reduce occurrence and severity of flaws on the surface of the coating. The amorphicity of the coating can be increased at a temperature at least above the glass transition temperature of the coating material. In one embodiment, the coating having increased amorphicity can be at least substantially amorphous.

The substrate having coatings thereon with an increased amorphicity can be incorporated into an electronic device prior to before the device is sold or used. In some cases, the amorphicity may further be increased during use of the electronic device.

Figure 4:
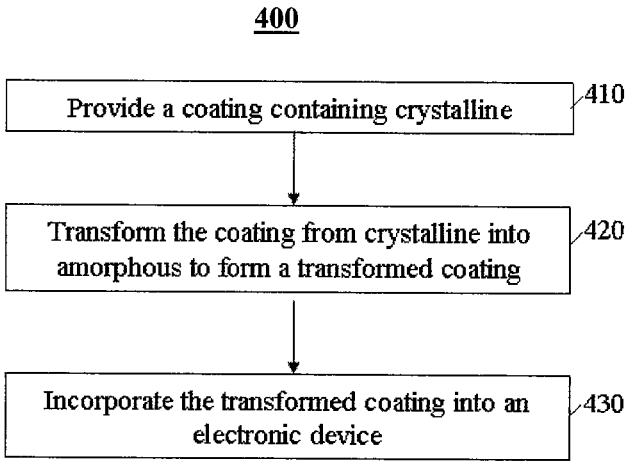
FIG. 4 depicts another exemplary method for processing a coating in accordance with various embodiments of the present teachings.

In one embodiment, as shown in FIG. 4, the coating may be provided at least partially containing crystalline, e.g., see block 410. The coating may then be, for example, frictionally transformed from crystalline into amorphous to form a transformed coating, e.g., see block 420. The substrate including the transformed coating can then be incorporated into an electronic device, e.g., see block 430. In some cases, the frictional transformation from crystalline into amorphous may be continued during use of the device.

In embodiments, the coating can be, for example, frictionally heated, locally heated, and/or thermoplastically treated to frictionally transform crystalline into amorphous. In embodiments, the coating can be processed by, for example, grinding, polishing, lapping, abrading, and combinations thereof to frictionally transform crystalline into amorphous, for example, at a temperature at least above the glass transition temperature of the coating material. This temperature does not include a critical crystallization temperature. Accordingly, the transformed coating can be at least substantially amorphous.

There are several advantages of the processed (e.g., transformed) coatings of the embodiments herein. For example, the coating can retain its integrity without separating from the surface of the substrate. In addition, it can withstand high temperature, and can be more ductile and fatigue resistant than unprocessed coatings.

The transformed coating can be more wear-resistant and/or corrosion resistant as compared with non-transformed coatings. Corrosion is the disintegration of an engineered material into its constituent atoms due to chemical reactions with its surroundings. This can refer to the electrochemical oxidation of metals in reaction with an oxidant such as oxygen. Formation of an oxide of a metal due to oxidation of the metal atoms in a solid solution is an example of electrochemical corrosion termed rusting. This type of damage typically can produce oxide(s) and/or salt(s) of the original metal. Corrosion can also refer to materials other than metals, such as ceramics or polymers, although in this context, the term degradation is more common. Metals and alloys could corrode merely from exposure to moisture in the air, but the process can be strongly affected by exposure to certain substances such as salts. Corrosion can be concentrated locally to form a pit or crack, or it can extend across a wide area more or less uniformly corroding the surface. Because corrosion is a diffusion controlled process, it can occur on exposed surfaces. As a result, methods to reduce the activity of the exposed surface, such as a coating, passivation and chromate-conversion, can increase a material's corrosion resistance.

The term "corrosion resistant" in the context of the coatings, e.g., the transformed coating, of the embodiments herein can refer to a material having a coating that has substantially less corrosion when exposed to an environment than that of the same material without the coating or without coating transformation (e.g., from crystalline to amorphous, and/or to increase amorphicity) that is exposed to the same environment. In one embodiment, the transformed coating described herein provides improved corrosion resistance relative to a coating that does not be transformed as described herein, with respect to chemical composition and the amorphous phase of the material.

The transformed coating preferably can exhibit desirable hardness, toughness, and bonding characteristics. The transformed coating can also be fully dense and suitable for very wide temperature ranges. The transformed coating can be at least partially amorphous, such as substantially amorphous or fully amorphous. For example, the coating can have at least 50% of its volume being amorphous, such as at least 60%, such as at least 80%, such as at least 90%, such as at least 95%, such as at least 99%, being amorphous.

Because of the properties of the frictionally transformable composition, a coating processed there-from can have superior properties. For example, the transformed coating can have high hardness. In one embodiment, the coating can have a Vickers hardness of at least about 800 HV-100 gm, such as at least about 850 HV-100 gm, such as at least about 1000 HV-100 gm, such as at least about 1100 HV-100 gm, such as at least about 1200 HV-100 gm, such as at least about 1250 HV-100 gm, such as at least about 1300 HV-100 gm.

The coating processed by the methods and compositions described herein can be dense. For example, it can have less than or equal to about 10% (volume) of porosity, such as less than or equal to about 5% of porosity, such as less than or equal to about 2% of porosity, such as less than or equal to about 1% of porosity, such as less than or equal to about 0.5% of porosity. Depending on the context, including the materials and the production and processing methods used, the aforedescribed percentages can be weight percentages, instead of volume percentages. It is particularly preferred that after the heating and cooling, the coating have significantly less than 0.5% porosity and be substantially smooth.

The thickness of the transformed coating can be from about 0.001" to about 0.1", such as about 0.005" to about 0.08", and such as from about 0.020" to about 0.050", such as from about 0.015" to about 0.03", such as from about 0.02" to about 0.025". In one embodiment wherein the coating is provided by arc spraying, the coating can have a thickness of about 0.02" to about 0.03". In an alternative embodiment wherein the coating is provided by HVOF, the coating may have a thickness of about 0.015" to about 0.03".

Provided in one embodiment also includes an electronic device. The electronic device may include one or more electronic device parts and a transformed coating disposed on at least one surface of the one or more electronic device parts.

Bulk-solidifying Amorphous Alloys, or Bulk Metallic Glasses ("BMG")

Bulk-solidifying amorphous alloys, or bulk metallic glasses ("BMG"), are a recently developed class of metallic materials. These alloys may be solidified and cooled at relatively slow rates, and they retain the amorphous, non-crystalline (i.e., glassy) state at room temperature. Amorphous alloys have many superior properties than their crystalline counterparts. However, if the cooling rate is not sufficiently high, crystals may form inside the alloy during cooling, so that the benefits of the amorphous state can be lost. For example, one challenge with the fabrication of bulk amorphous alloy parts is partial crystallization of the parts due to either slow cooling or impurities in the raw alloy material. As a high degree of amorphicity (and, conversely, a low degree of crystallinity) is desirable in BMG parts, there is a need to develop methods for casting BMG parts having controlled amount of amorphicity.

FIG. 1 (obtained from U.S. Pat. No. 7,575,040) shows a viscosity-temperature graph of an exemplary bulk solidifying amorphous alloy, from the VIT-001 series of Zr—Ti—Ni—Cu—Be family manufactured by Liquidmetal Technology. It should be noted that there is no clear liquid/solid transformation for a bulk solidifying amorphous metal during the formation of an amorphous solid. The molten alloy becomes more and more viscous with increasing undercooling until it approaches solid form around the glass transition temperature. Accordingly, the temperature of solidification front for bulk solidifying amorphous alloys can be around glass transition temperature, where the alloy will practically act as a solid for the purposes of pulling out the quenched amorphous sheet product.

Figure 2:
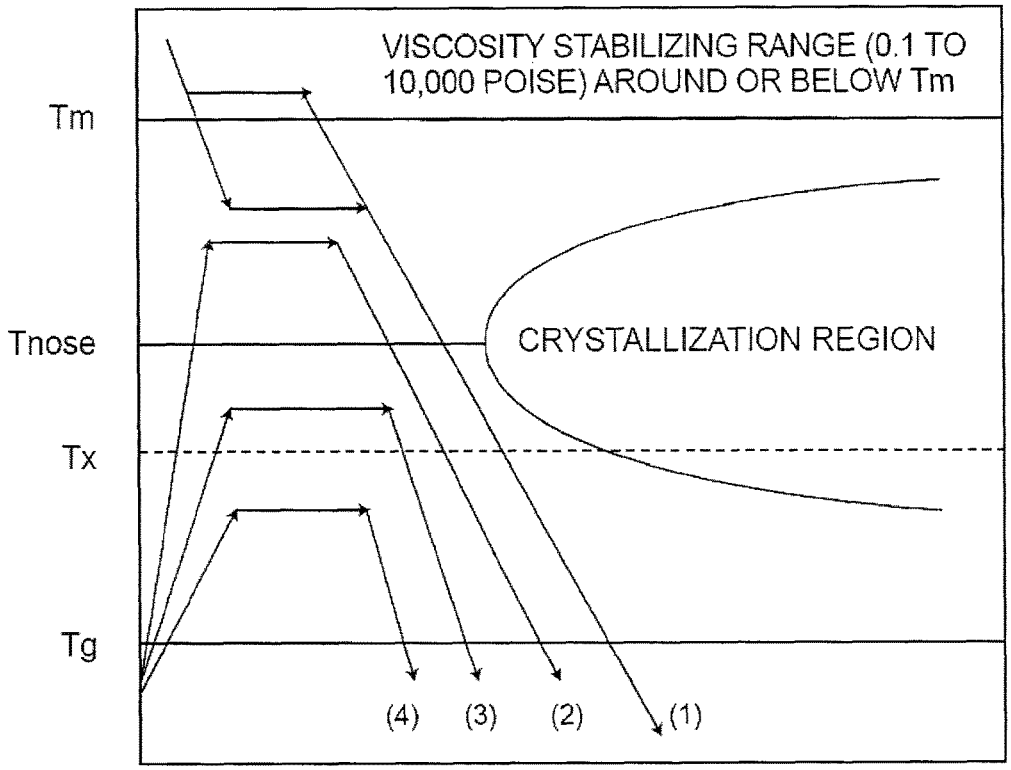
FIG. 2 provides a schematic of a time-temperature-transformation (TTT) diagram for an exemplary bulk solidifying amorphous alloy.

FIG. 2 (obtained from U.S. Pat. No. 7,575,040) shows the time-temperature-transformation (TTT) cooling curve of an exemplary bulk solidifying amorphous alloy, or TTT diagram. Bulk-solidifying amorphous metals do not experience a liquid/solid crystallization transformation upon cooling, as with conventional metals. Instead, the highly fluid, non crystalline form of the metal found at high temperatures (near a "melting temperature" Tm) becomes more viscous as the temperature is reduced (near to the glass transition temperature Tg), eventually taking on the outward physical properties of a conventional solid.

Even though there is no liquid/crystallization transformation for a bulk solidifying amorphous metal, a "melting temperature" Tm may be defined as the thermodynamic liquidus temperature of the corresponding crystalline phase. Under this regime, the viscosity of bulk-solidifying amorphous alloys at the melting temperature could lie in the range of about 0.1 poise to about 10,000 poise, and even sometimes under 0.01 poise. A lower viscosity at the "melting temperature" would provide faster and complete filling of intricate portions of the shell/mold with a bulk solidifying amorphous metal for forming the BMG parts. Furthermore, the cooling rate of the molten metal to form a BMG part has to such that the time-temperature profile during cooling does not traverse through the nose-shaped region bounding the crystallized region in the TTT diagram of FIG. 2. In FIG. 2, Tnose is the critical crystallization temperature Tx where crystallization is most rapid and occurs in the shortest time scale.

The supercooled liquid region, the temperature region between Tg and Tx is a manifestation of the extraordinary stability against crystallization of bulk solidification alloys. In this temperature region the bulk solidifying alloy can exist as a high viscous liquid. The viscosity of the bulk solidifying alloy in the supercooled liquid region can vary between $10^{12}$ Pa s at the glass transition temperature down to $10^{5}$ Pa s at the crystallization temperature, the high temperature limit of the supercooled liquid region. Liquids with such viscosities can undergo substantial plastic strain under an applied pressure. The embodiments herein make use of the large plastic formability in the supercooled liquid region as a forming and separating method.

One needs to clarify something about Tx. Technically, the nose-shaped curve shown in the TTT diagram describes Tx as a function of temperature and time. Thus, regardless of the trajectory that one takes while heating or cooling a metal alloy, when one hits the TTT curve, one has reached Tx. In FIG. 2, Tx is shown as a dashed line as Tx can vary from close to Tm to close to Tg.

The schematic TTT diagram of FIG. 2 shows processing methods of die casting from at or above Tm to below Tg without the time-temperature trajectory (shown as (1) as an example trajectory) hitting the TTT curve. During die casting, the forming takes place substeantially simultaneously with fast cooling to avoid the trajectory hitting the TTT curve. The processing methods for superplastic forming (SPF) from at or below Tg to below Tm without the time-temperature trajectory (shown as (2), (3) and (4) as example trajectories) hitting the TTT curve. In SPF, the amorphous BMG is reheated into the supercooled liquid region where the available processing window could be much larger than die casting, resulting in better controllability of the process. The SPF process does not require fast cooling to avoid crystallization during cooling. Also, as shown by example trajectories (2), (3) and (4), the SPF can be carried out with the highest temperature during SPF being above Tnose or below Tnose, up to about Tm. If one heats up a piece of amorphous alloy but manages to avoid hitting the TTT curve, you have heated "between Tg and Tm", but one would have not reached Tx.

Typical differential scanning calorimeter (DSC) heating curves of bulk-solidifying amorphous alloys taken at a heating rate of 20 C/min describe, for the most part, a particular trajectory across the TTT data where one would likely see a Tg at a certain temperature, a Tx when the DSC heating ramp crosses the TTT crystallization onset, and eventually melting peaks when the same trajectory crosses the temperature range for melting. If one heats a bulk-solidifying amorphous alloy at a rapid heating rate as shown by the ramp up portion of trajectories (2), (3) and (4) in FIG. 2, then one could avoid the TTT curve entirely, and the DSC data would show a glass transition but no Tx upon heating. Another way to think about it is trajectories (2), (3) and (4) can fall anywhere in temperature between the nose of the TTT curve (and even above it) and the Tg line, as long as it does not hit the crystallization curve. That just means that the horizontal plateau in trajectories might get much shorter as one increases the processing temperature.

Phase

The term "phase" herein can refer to one that can be found in a thermodynamic phase diagram. A phase is a region of space (e.g., a thermodynamic system) throughout which all physical properties of a material are essentially uniform. Examples of physical properties include density, index of refraction, chemical composition and lattice periodicity. A simple description of a phase is a region of material that is chemically uniform, physically distinct, and/or mechanically separable. For example, in a system consisting of ice and water in a glass jar, the ice cubes are one phase, the water is a second phase, and the humid air over the water is a third phase. The glass of the jar is another separate phase. A phase can refer to a solid solution, which can be a binary, tertiary, quaternary, or more, solution, or a compound, such as an intermetallic compound. As another example, an amorphous phase is distinct from a crystalline phase.

Metal, Transition Metal, and Non-metal

The term "metal" refers to an electropositive chemical element. The term "element" in this Specification refers generally to an element that can be found in a Periodic Table. Physically, a metal atom in the ground state contains a partially filled band with an empty state close to an occupied state. The term "transition metal" is any of the metallic elements within Groups 3 to 12 in the Periodic Table that have an incomplete inner electron shell and that serve as transitional links between the most and the least electropositive in a series of elements. Transition metals are characterized by multiple valences, colored compounds, and the ability to form stable complex ions. The term "nonmetal" refers to a chemical element that does not have the capacity to lose electrons and form a positive ion.

Depending on the application, any suitable nonmetal elements, or their combinations, can be used. The alloy (or "alloy composition") can include multiple nonmetal elements, such as at least two, at least three, at least four, or more, nonmetal elements. A nonmetal element can be any element that is found in Groups 13-17 in the Periodic Table. For example, a nonmetal element can be any one of F, Cl, Br, I, At, O, S, Se, Te, Po, N, P, As, Sb, Bi, C, Si, Ge, Sn, Pb, and B. Occasionally, a nonmetal element can also refer to certain metalloids (e.g., B, Si, Ge, As, Sb, Te, and Po) in Groups 13-17. In one embodiment, the nonmetal elements can include B, Si, C, P, or combinations thereof. Accordingly, for example, the alloy can include a boride, a carbide, or both.

A transition metal element can be any of scandium, titanium, vanadium, chromium, manganese, iron, cobalt, nickel, copper, zinc, yttrium, zirconium, niobium, molybdenum, technetium, ruthenium, rhodium, palladium, silver, cadmium, hafnium, tantalum, tungsten, rhenium, osmium, iridium, platinum, gold, mercury, rutherfordium, dubnium, seaborgium, bohrium, hassium, meitnerium, ununnilium, unununium, and ununbium. In one embodiment, a BMG containing a transition metal element can have at least one of Sc, Y, La, Ac, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd, and Hg. Depending on the application, any suitable transitional metal elements, or their combinations, can be used. The alloy composition can include multiple transitional metal elements, such as at least two, at least three, at least four, or more, transitional metal elements.

The presently described alloy or alloy "sample" or "specimen" alloy can have any shape or size. For example, the alloy can have a shape of a particulate, which can have a shape such as spherical, ellipsoid, wire-like, rod-like, sheet-like, flake-like, or an irregular shape. The particulate can have any size. For example, it can have an average diameter of between about 1 micron and about 100 microns, such as between about 5 microns and about 80 microns, such as between about 10 microns and about 60 microns, such as between about 15 microns and about 50 microns, such as between about 15 microns and about 45 microns, such as between about 20 microns and about 40 microns, such as between about 25 microns and about 35 microns. For example, in one embodiment, the average diameter of the particulate is between about 25 microns and about 44 microns. In some embodiments, smaller particulates, such as those in the nanometer range, or larger particulates, such as those bigger than 100 microns, can be used.

The alloy sample or specimen can also be of a much larger dimension. For example, it can be a bulk structural component, such as an ingot, housing/casing of an electronic device or even a portion of a structural component that has dimensions in the millimeter, centimeter, or meter range.

Solid Solution

The term "solid solution" refers to a solid form of a solution. The term "solution" refers to a mixture of two or more substances, which may be solids, liquids, gases, or a combination of these. The mixture can be homogeneous or heterogeneous. The term "mixture" is a composition of two or more substances that are combined with each other and are generally capable of being separated. Generally, the two or more substances are not chemically combined with each other.

Alloy

In some embodiments, the alloy composition described herein can be fully alloyed. In one embodiment, an "alloy" refers to a homogeneous mixture or solid solution of two or more metals, the atoms of one replacing or occupying interstitial positions between the atoms of the other; for example, brass is an alloy of zinc and copper. An alloy, in contrast to a composite, can refer to a partial or complete solid solution of one or more elements in a metal matrix, such as one or more compounds in a metallic matrix. The term alloy herein can refer to both a complete solid solution alloy that can give single solid phase microstructure and a partial solution that can give two or more phases. An alloy composition described herein can refer to one comprising an alloy or one comprising an alloy-containing composite.

Thus, a fully alloyed alloy can have a homogenous distribution of the constituents, be it a solid solution phase, a compound phase, or both. The term "fully alloyed" used herein can account for minor variations within the error tolerance. For example, it can refer to at least 90% alloyed, such as at least 95% alloyed, such as at least 99% alloyed, such as at least 99.5% alloyed, such as at least 99.9% alloyed. The percentage herein can refer to either volume percent or weight percentage, depending on the context. These percentages can be balanced by impurities, which can be in terms of composition or phases that are not a part of the alloy.

Amorphous or Non-crystalline Solid

An "amorphous" or "non-crystalline solid" is a solid that lacks lattice periodicity, which is characteristic of a crystal. As used herein, an "amorphous solid" includes "glass" which is an amorphous solid that softens and transforms into a liquid-like state upon heating through the glass transition. Generally, amorphous materials lack the long-range order characteristic of a crystal, though they can possess some short-range order at the atomic length scale due to the nature of chemical bonding. The distinction between amorphous solids and crystalline solids can be made based on lattice periodicity as determined by structural characterization techniques such as x-ray diffraction and transmission electron microscopy.

The terms "order" and "disorder" designate the presence or absence of some symmetry or correlation in a many-particle system. The terms "long-range order" and "short-range order" distinguish order in materials based on length scales.

The strictest form of order in a solid is lattice periodicity: a certain pattern (the arrangement of atoms in a unit cell) is repeated again and again to form a translationally invariant tiling of space. This is the defining property of a crystal. Possible symmetries have been classified in 14 Bravais lattices and 230 space groups.

Lattice periodicity implies long-range order. If only one unit cell is known, then by virtue of the translational symmetry it is possible to accurately predict all atomic positions at arbitrary distances. The converse is generally true, except, for example, in quasi-crystals that have perfectly deterministic tilings but do not possess lattice periodicity.

Long-range order characterizes physical systems in which remote portions of the same sample exhibit correlated behavior. This can be expressed as a correlation function, namely the spin-spin correlation function: $G(x,x')=\langle (x),s(x')\rangle$.

In the above function, s is the spin quantum number and x is the distance function within the particular system. This function is equal to unity when x=x' and decreases as the distance $|x-x'|$ increases. Typically, it decays exponentially to zero at large distances, and the system is considered to be disordered. If, however, the correlation function decays to a constant value at large $|x-x'|$, then the system can be said to possess long-range order. If it decays to zero as a power of the distance, then it can be called quasi-long-range order. Note that what constitutes a large value of $|x-x'|$ is relative.

A system can be said to present quenched disorder when some parameters defining its behavior are random variables that do not evolve with time (i.e., they are quenched or frozen)—e.g., spin glasses. It is opposite to annealed disorder, where the random variables are allowed to evolve themselves. Embodiments herein include systems comprising quenched disorder.

The alloy described herein can be crystalline, partially crystalline, amorphous, or substantially amorphous. For example, the alloy sample/specimen can include at least some crystallinity, with grains/crystals having sizes in the nanometer and/or micrometer ranges. Alternatively, the alloy can be substantially amorphous, such as fully amorphous. In one embodiment, the alloy composition is at least substantially not amorphous, such as being substantially crystalline, such as being entirely crystalline.

In one embodiment, the presence of a crystal or a plurality of crystals in an otherwise amorphous alloy can be construed as a "crystalline phase" therein. The degree of crystallinity (or "crystallinity" for short in some embodiments) of an alloy can refer to the amount of the crystalline phase present in the alloy. The degree can refer to, for example, a fraction of crystals present in the alloy. The fraction can refer to volume fraction or weight fraction, depending on the context. A measure of how "amorphous" an amorphous alloy is can be amorphicity. Amorphicity can be measured in terms of a degree of crystallinity. For example, in one embodiment, an alloy having a low degree of crystallinity can be said to have a high degree of amorphicity. In one embodiment, for example, an alloy having 60 vol % crystalline phase can have a 40 vol % amorphous phase.

Amorphous Alloy or Amorphous Metal

An "amorphous alloy" is an alloy having an amorphous content of more than 50% by volume, preferably more than 90% by volume of amorphous content, more preferably more than 95% by volume of amorphous content, and most preferably more than 99% to almost 100% by volume of amorphous content. Note that, as described above, an alloy high in amorphicity is equivalently low in degree of crystallinity. An "amorphous metal" is an amorphous metal material with a disordered atomic-scale structure. In contrast to most metals, which are crystalline and therefore have a highly ordered arrangement of atoms, amorphous alloys are non-crystalline. Materials in which such a disordered structure is produced directly from the liquid state during cooling are sometimes referred to as "glasses." Accordingly, amorphous metals are commonly referred to as "metallic glasses" or "glassy metals." In one embodiment, a bulk metallic glass ("BMG") can refer to an alloy, of which the microstructure is at least partially amorphous. However, there are several ways besides extremely rapid cooling to produce amorphous metals, including physical vapor deposition, solid-state reaction, ion irradiation, melt spinning, and mechanical alloying. Amorphous alloys can be a single class of materials, regardless of how they are prepared.

Amorphous metals can be produced through a variety of quick-cooling methods. For instance, amorphous metals can be produced by sputtering molten metal onto a spinning metal disk. The rapid cooling, on the order of millions of degrees a second, can be too fast for crystals to form, and the material is thus "locked in" a glassy state. Also, amorphous metals/alloys can be produced with critical cooling rates low enough to allow formation of amorphous structures in thick layers—e.g., bulk metallic glasses.

The terms "bulk metallic glass" ("BMG"), bulk amorphous alloy ("BAA"), and bulk solidifying amorphous alloy are used interchangeably herein. They refer to amorphous alloys having the smallest dimension at least in the millimeter range. For example, the dimension can be at least about 0.5 mm, such as at least about 1 mm, such as at least about 2 mm, such as at least about 4 mm, such as at least about 5 mm, such as at least about 6 mm, such as at least about 8 mm, such as at least about 10 mm, such as at least about 12 mm. Depending on the geometry, the dimension can refer to the diameter, radius, thickness, width, length, etc. A BMG can also be a metallic glass having at least one dimension in the centimeter range, such as at least about 1.0 cm, such as at least about 2.0 cm, such as at least about 5.0 cm, such as at least about 10.0 cm. In some embodiments, a BMG can have at least one dimension at least in the meter range. A BMG can take any of the shapes or forms described above, as related to a metallic glass. Accordingly, a BMG described herein in some embodiments can be different from a thin film made by a conventional deposition technique in one important aspect—the former can be of a much larger dimension than the latter.

Amorphous metals can be an alloy rather than a pure metal. The alloys may contain atoms of significantly different sizes, leading to low free volume (and therefore having viscosity up to orders of magnitude higher than other metals and alloys) in a molten state. The viscosity prevents the atoms from moving enough to form an ordered lattice. The material structure may result in low shrinkage during cooling and resistance to plastic deformation. The absence of grain boundaries, the weak spots of crystalline materials in some cases, may, for example, lead to better resistance to wear and corrosion. In one embodiment, amorphous metals, while technically glasses, may also be much tougher and less brittle than oxide glasses and ceramics.

Thermal conductivity of amorphous materials may be lower than that of their crystalline counterparts. To achieve formation of an amorphous structure even during slower cooling, the alloy may be made of three or more components, leading to complex crystal units with higher potential energy and lower probability of formation. The formation of amorphous alloy can depend on several factors: the composition of the components of the alloy; the atomic radius of the components (preferably with a significant difference of over 12% to achieve high packing density and low free volume); and the negative heat of mixing the combination of components, inhibiting crystal nucleation and prolonging the time the molten metal stays in a supercooled state. However, as the formation of an amorphous alloy is based on many different variables, it can be difficult to make a prior determination of whether an alloy composition would form an amorphous alloy.

Amorphous alloys, for example, of boron, silicon, phosphorus, and other glass formers with magnetic metals (iron, cobalt, nickel) may be magnetic, with low coercivity and high electrical resistance. The high resistance leads to low losses by eddy currents when subjected to alternating magnetic fields, a property useful, for example, as transformer magnetic cores.

Amorphous alloys may have a variety of potentially useful properties. In particular, they tend to be stronger than crystalline alloys of similar chemical composition, and they can sustain larger reversible ("elastic") deformations than crystalline alloys. Amorphous metals derive their strength directly from their non-crystalline structure, which can have none of the defects (such as dislocations) that limit the strength of crystalline alloys. For example, one modern amorphous metal, known as Vitreloy™, has a tensile strength that is almost twice that of high-grade titanium. In some embodiments, metallic glasses at room temperature are not ductile and tend to fail suddenly when loaded in tension, which limits the material applicability in reliability-critical applications, as the impending failure is not evident. Therefore, to overcome this challenge, metal matrix composite materials having a metallic glass matrix containing dendritic particles or fibers of a ductile crystalline metal can be used. Alternatively, a BMG low in element(s) that tend to cause embitterment (e.g., Ni) can be used. For example, a Ni-free BMG can be used to improve the ductility of the BMG.

Another useful property of bulk amorphous alloys is that they can be true glasses; in other words, they can soften and flow upon heating. This can allow for easy processing, such as by injection molding, in much the same way as polymers. As a result, amorphous alloys can be used for making sports equipment, medical devices, electronic components and equipment, and thin films. Thin films of amorphous metals can be deposited as protective coatings via a high velocity oxygen fuel technique.

A material can have an amorphous phase, a crystalline phase, or both. The amorphous and crystalline phases can have the same chemical composition and differ only in the microstructure—i.e., one amorphous and the other crystalline. Microstructure in one embodiment refers to the structure of a material as revealed by a microscope at 25× magnification or higher. Alternatively, the two phases can have different chemical compositions and microstructures. For example, a composition can be partially amorphous, substantially amorphous, or completely amorphous.

As described above, the degree of amorphicity (and conversely the degree of crystallinity) can be measured by fraction of crystals present in the alloy. The degree can refer to volume fraction of weight fraction of the crystalline phase present in the alloy. A partially amorphous composition can refer to a composition of at least about 5 vol % of which is of an amorphous phase, such as at least about 10 vol %, such as at least about 20 vol %, such as at least about 40 vol %, such as at least about 60 vol %, such as at least about 80 vol %, such as at least about 90 vol %. The terms "substantially" and "about" have been defined elsewhere in this application. Accordingly, a composition that is at least substantially amorphous can refer to one of which at least about 90 vol % is amorphous, such as at least about 95 vol %, such as at least about 98 vol %, such as at least about 99 vol %, such as at least about 99.5 vol %, such as at least about 99.8 vol %, such as at least about 99.9 vol %. In one embodiment, a substantially amorphous composition can have some incidental, insignificant amount of crystalline phase present therein.

In one embodiment, an amorphous alloy composition can be homogeneous with respect to the amorphous phase. A substance that is uniform in composition is homogeneous. This is in contrast to a substance that is heterogeneous. The term "composition" refers to the chemical composition and/or microstructure in the substance. A substance is homogeneous when a volume of the substance is divided in half and both halves have substantially the same composition. For example, a particulate suspension is homogeneous when a volume of the particulate suspension is divided in half and both halves have substantially the same volume of particles. However, it might be possible to see the individual particles under a microscope. Another example of a homogeneous substance is air where different ingredients therein are equally suspended, though the particles, gases and liquids in air can be analyzed separately or separated from air.

A composition that is homogeneous with respect to an amorphous alloy can refer to one having an amorphous phase substantially uniformly distributed throughout its microstructure. In other words, the composition macroscopically includes a substantially uniformly distributed amorphous alloy throughout the composition. In an alternative embodiment, the composition can be of a composite, having an amorphous phase having therein a non-amorphous phase. The non-amorphous phase can be a crystal or a plurality of crystals. The crystals can be in the form of particulates of any shape, such as spherical, ellipsoid, wire-like, rod-like, sheet-like, flake-like, or an irregular shape. In one embodiment, it can have a dendritic form. For example, an at least partially amorphous composite composition can have a crystalline phase in the shape of dendrites dispersed in an amorphous phase matrix; the dispersion can be uniform or non-uniform, and the amorphous phase and the crystalline phase can have the same or a different chemical composition. In one embodiment, they have substantially the same chemical composition. In another embodiment, the crystalline phase can be more ductile than the BMG phase.

The methods described herein can be applicable to any type of amorphous alloy. Similarly, the amorphous alloy described herein as a constituent of a composition or article can be of any type. The amorphous alloy can include the element Zr, Hf, Ti, Cu, Ni, Pt, Pd, Fe, Mg, Au, La, Ag, Al, Mo, Nb, Be, or combinations thereof. Namely, the alloy can include any combination of these elements in its chemical formula or chemical composition. The elements can be present at different weight or volume percentages. For example, an iron "based" alloy can refer to an alloy having a non-insignificant weight percentage of iron present therein, the weight percent can be, for example, at least about 20 wt %, such as at least about 40 wt %, such as at least about 50 wt %, such as at least about 60 wt %, such as at least about 80 wt %. Alternatively, in one embodiment, the above-described percentages can be volume percentages, instead of weight percentages. Accordingly, an amorphous alloy can be zirconium-based, titanium-based, platinum-based, palladium-based, gold-based, silver-based, copper-based, iron-based, nickel-based, aluminum-based, molybdenum-based, and the like. The alloy can also be free of any of the aforementioned elements to suit a particular purpose. For example, in some embodiments, the alloy, or the composition including the alloy, can be substantially free of nickel, aluminum, titanium, beryllium, or combinations thereof. In one embodiment, the alloy or the composite is completely free of nickel, aluminum, titanium, beryllium, or combinations thereof.

For example, the amorphous alloy can have the formula (Zr, Ti)a(Ni, Cu, Fe)b(Be, Al, Si, B)c, wherein a, b, and c each represents a weight or atomic percentage. In one embodiment, a is in the range of from 30 to 75, b is in the range of from 5 to 60, and c is in the range of from 0 to 50 in atomic percentages. Alternatively, the amorphous alloy can have the formula (Zr, Ti)a(Ni, Cu)b(Be)c, wherein a, b, and c each represents a weight or atomic percentage. In one embodiment, a is in the range of from 40 to 75, b is in the range of from 5 to 50, and c is in the range of from 5 to 50 in atomic percentages. The alloy can also have the formula (Zr, Ti)a(Ni, Cu)b(Be)c, wherein a, b, and c each represents a weight or atomic percentage. In one embodiment, a is in the range of from 45 to 65, b is in the range of from 7.5 to 35, and c is in the range of from 10 to 37.5 in atomic percentages. Alternatively, the alloy can have the formula (Zr)a(Nb, Ti)b(Ni, Cu)c(Al)d, wherein a, b, c, and d each represents a weight or atomic percentage. In one embodiment, a is in the range of from 45 to 65, b is in the range of from 0 to 10, c is in the range of from 20 to 40 and d is in the range of from 7.5 to 15 in atomic percentages. One exemplary embodiment of the aforedescribed alloy system is a Zr—Ti—Ni—Cu—Be based amorphous alloy under the trade name Vitreloy™, such as Vitreloy-1 and Vitreloy-101, as fabricated by Liquidmetal Technologies, CA, USA. Some examples of amorphous alloys of the different systems are provided in Table 1 and Table 2.

TABLE 1

Exemplary amorphous alloy compositions

| Alloy | Atm % | Atm % | Atm % | Atm % | Atm % | Atm % | Atm % | Atm % |
|---|---|---|---|---|---|---|---|---|
| 1 | Fe | Mo | Ni | Cr | P | C | B | |
| | 68.00% | 5.00% | 5.00% | 2.00% | 12.50% | 5.00% | 2.50% | |
| 2 | Fe | Mo | Ni | Cr | P | C | B | Si |
| | 68.00% | 5.00% | 5.00% | 2.00% | 11.00% | 5.00% | 2.50% | 1.50% |
| 3 | Pd | Cu | Co | P | | | | |
| | 44.48% | 32.35% | 4.05% | 19.11% | | | | |
| 4 | Pd | Ag | Si | P | | | | |
| | 77.50% | 6.00% | 9.00% | 7.50% | | | | |
| 5 | Pd | Ag | Si | P | Ge | | | |
| | 79.00% | 3.50% | 9.50% | 6.00% | 2.00% | | | |
| 6 | Pt | Cu | Ag | P | B | Si | | |
| | 74.70% | 1.50% | 0.30% | 18.0% | 4.00% | 1.50% | | |

TABLE 2

Additional Exemplary amorphous alloy compositions (atomic %)

| Alloy | Atm % | Atm % | Atm % | Atm % | Atm % | Atm % |
|---|---|---|---|---|---|---|
| 1 | Zr | Ti | Cu | Ni | Be | |
| | 41.20% | 13.80% | 12.50% | 10.00% | 22.50% | |
| 2 | Zr | Ti | Cu | Ni | Be | |
| | 44.00% | 11.00% | 10.00% | 10.00% | 25.00% | |

TABLE 2-continued

Additional Exemplary amorphous alloy compositions (atomic %)

| Alloy | Atm % | Atm % | Atm % | Atm % | Atm % | Atm % |
|---|---|---|---|---|---|---|
| 3 | Zr | Ti | Cu | Ni | Nb | Be |
| | 56.25% | 11.25% | 6.88% | 5.63% | 7.50% | 12.50% |
| 4 | Zr | Ti | Cu | Ni | Al | Be |
| | 64.75% | 5.60% | 14.90% | 11.15% | 2.60% | 1.00% |
| 5 | Zr | Ti | Cu | Ni | Al | |
| | 52.50% | 5.00% | 17.90% | 14.60% | 10.00% | |
| 6 | Zr | Nb | Cu | Ni | Al | |
| | 57.00% | 5.00% | 15.40% | 12.60% | 10.00% | |
| 7 | Zr | Cu | Ni | Al | | |
| | 50.75% | 36.23% | 4.03% | 9.00% | | |
| 8 | Zr | Ti | Cu | Ni | Be | |
| | 46.75% | 8.25% | 7.50% | 10.00% | 27.50% | |
| 9 | Zr | Ti | Ni | Be | | |
| | 21.67% | 43.33% | 7.50% | 27.50% | | |
| 10 | Zr | Ti | Cu | Be | | |
| | 35.00% | 30.00% | 7.50% | 27.50% | | |
| 11 | Zr | Ti | Co | Be | | |
| | 35.00% | 30.00% | 6.00% | 29.00% | | |
| 12 | Zr | Ti | Fe | Be | | |
| | 35.00% | 30.00% | 2.00% | 33.00% | | |
| 13 | Au | Ag | Pd | Cu | Si | |
| | 49.00% | 5.50% | 2.30% | 26.90% | 16.30% | |
| 14 | Au | Ag | Pd | Cu | Si | |
| | 50.90% | 3.00% | 2.30% | 27.80% | 16.00% | |
| 15 | Pt | Cu | Ni | P | | |
| | 57.50% | 14.70% | 5.30% | 22.50% | | |
| 16 | Zr | Ti | Nb | Cu | Be | |
| | 36.60% | 31.40% | 7.00% | 5.90% | 19.10% | |
| 17 | Zr | Ti | Nb | Cu | Be | |
| | 38.30% | 32.90% | 7.30% | 6.20% | 15.30% | |
| 18 | Zr | Ti | Nb | Cu | Be | |
| | 39.60% | 33.90% | 7.60% | 6.40% | 12.50% | |
| 19 | Cu | Ti | Zr | Ni | | |
| | 47.00% | 34.00% | 11.00% | 8.00% | | |
| 20 | Zr | Co | Al | | | |
| | 55.00% | 25.00% | 20.00% | | | |

Other exemplary ferrous metal-based alloys include compositions such as those disclosed in U.S. Patent Application Publication Nos. 2007/0079907 and 2008/0118387. These compositions include the Fe(Mn, Co, Ni, Cu) (C, Si, B, P, Al) system, wherein the Fe content is from 60 to 75 atomic percentage, the total of (Mn, Co, Ni, Cu) is in the range of from 5 to 25 atomic percentage, and the total of (C, Si, B, P, Al) is in the range of from 8 to 20 atomic percentage, as well as the exemplary composition Fe48Cr15Mo14Y2C15B6. They also include the alloy systems described by Fe—Cr—Mo—(Y,Ln)—C—B, Co—Cr—Mo—Ln—C—B, Fe—Mn—Cr—Mo—(Y,Ln)—C—B, (Fe, Cr, Co)—(Mo,Mn)—(C,B)—Y, Fe—(Co,Ni)—(Zr,Nb,Ta)—(Mo,W)—B, Fe—(Al,Ga)—(P,C,B,Si,Ge), Fe—(Co, Cr,Mo,Ga,Sb)—P—B—C, (Fe, Co)—B—Si—Nb alloys, and Fe—(Cr—Mo)—(C,B)—Tm, where Ln denotes a lanthanide element and Tm denotes a transition metal element. Furthermore, the amorphous alloy can also be one of the exemplary compositions $Fe_{80}P_{12.5}C_5B_{2.5}$, $Fe_{80}P_{11}C_5B_{2.5}Si_{1.5}$, $Fe_{74.5}Mo_{5.5}P_{12.5}C_5B_{2.5}$, $Fe_{74.5}Mo_{5.5}P_{11}C_5B_{2.5}Si_{1.5}$, $Fe_{70}Mo_5Ni_5P_{12.5}C_5B_{2.5}$, $Fe_{70}Mo_5Ni_5P_{11}C_5B_{2.5}Si_{1.5}$, $Fe_{68}Mo_5Ni_5Cr_2P_{12.5}C_5B_{2.5}$, and $Fe_{68}Mo_5Ni_5Cr_2P_{11}C_5B_{2.5}Si_{1.5}$, described in U.S. Patent Application Publication No. 2010/0300148.

The amorphous alloys can also be ferrous alloys, such as (Fe, Ni, Co) based alloys. Examples of such compositions are disclosed in U.S. Pat. Nos. 6,325,868; 5,288,344; 5,368,659; 5,618,359; and 5,735,975, Inoue et al., Appl. Phys. Lett., Volume 71, p 464 (1997), Shen et al., Mater. Trans., JIM, Volume 42, p 2136 (2001), and Japanese Patent Application No. 200126277 (Pub. No. 2001303218 A). One exemplary composition is Fe72Al5Ga2Pl1C6B4. Another example is Fe72Al7Zr1 0Mo5W2B15. Another iron-based alloy system that can be used in the coating herein is disclosed in U.S. Patent Application Publication No. 2010/0084052, wherein the amorphous metal contains, for example, manganese (1 to 3 atomic %), yttrium (0.1 to 10 atomic %), and silicon (0.3 to 3.1 atomic %) in the range of composition given in parentheses; and that contains the following elements in the specified range of composition given in parentheses: chromium (15 to 20 atomic %), molybdenum (2 to 15 atomic %), tungsten (1 to 3 atomic %), boron (5 to 16 atomic %), carbon (3 to 16 atomic %), and the balance iron.

The amorphous alloy can also be one of the Pt- or Pd-based alloys described by U.S. Patent Application Publication Nos. 2008/0135136, 2009/0162629, and 2010/0230012. Exemplary compositions include $Pd_{44.48}Cu_{32.35}Co_{4.05}P_{19.11}$, $Pd_{77.5}Ag_6Si_9P_{7.5}$, and $Pt_{74.7}Cu_{1.5}Ag_{0.3}P_{18}B_4Si_{1.5}$.

The aforedescribed amorphous alloy systems can further include additional elements, such as additional transition metal elements, including Nb, Cr, V, and Co. The additional elements can be present at less than or equal to about 30 wt %, such as less than or equal to about 20 wt %, such as less than or equal to about 10 wt %, such as less than or equal to about 5 wt %. In one embodiment, the additional, optional element is at least one of cobalt, manganese, zirconium, tantalum, niobium, tungsten, yttrium, titanium, vanadium and hafnium to form carbides and further improve wear and corrosion resistance. Further optional elements may include phosphorous, germanium and arsenic, totaling up to about 2%, and preferably less than 1%, to reduce melting point. Otherwise incidental impurities should be less than about 2% and preferably 0.5%.

In some embodiments, a composition having an amorphous alloy can include a small amount of impurities. The impurity elements can be intentionally added to modify the properties of the composition, such as improving the mechanical properties (e.g., hardness, strength, fracture mechanism, etc.) and/or improving the corrosion resistance. Alternatively, the impurities can be present as inevitable, incidental impurities, such as those obtained as a byproduct of processing and manufacturing. The impurities can be less than or equal to about 10 wt %, such as about 5 wt %, such as about 2 wt %, such as about 1 wt %, such as about 0.5 wt %, such as about 0.1 wt %. In some embodiments, these percentages can be volume percentages instead of weight percentages. In one embodiment, the alloy sample/composition consists essentially of the amorphous alloy (with only a small incidental amount of impurities). In another embodiment, the composition includes the amorphous alloy (with no observable trace of impurities).

In one embodiment, the final parts exceeded the critical casting thickness of the bulk solidifying amorphous alloys.

In embodiments herein, the existence of a supercooled liquid region in which the bulk-solidifying amorphous alloy can exist as a high viscous liquid allows for superplastic forming. Large plastic deformations can be obtained. The ability to undergo large plastic deformation in the supercooled liquid region is used for the forming and/or cutting process. As oppose to solids, the liquid bulk solidifying alloy deforms locally which drastically lowers the required energy for cutting and forming. The ease of cutting and forming depends on the temperature of the alloy, the mold, and the cutting tool. As higher is the temperature, the lower is the viscosity, and consequently easier is the cutting and forming.

Embodiments herein can utilize a thermoplastic-forming process with amorphous alloys carried out between Tg and Tx, for example. Herein, Tx and Tg are determined from standard DSC measurements at typical heating rates (e.g. 20° C./min) as the onset of crystallization temperature and the onset of glass transition temperature.

The amorphous alloy components can have the critical casting thickness and the final part can have thickness that is thicker than the critical casting thickness. Moreover, the time and temperature of the heating and shaping operation is selected such that the elastic strain limit of the amorphous alloy could be substantially preserved to be not less than 1.0%, and preferably not being less than 1.5%. In the context of the embodiments herein, temperatures around glass transition means the forming temperatures can be below glass transition, at or around glass transition, and above glass transition temperature, but preferably at temperatures below the crystallization temperature Tx. The cooling step is carried out at rates similar to the heating rates at the heating step, and preferably at rates greater than the heating rates at the heating step. The cooling step is also achieved preferably while the forming and shaping loads are still maintained.

Electronic Devices

The embodiments herein can be valuable in the fabrication of electronic devices using a BMG. An electronic device herein can refer to any electronic device known in the art. For example, it can be a telephone, such as a cell phone, and a land-line phone, or any communication device, such as a smart phone, including, for example an iPhone™, and an electronic email sending/receiving device. It can be a part of a display, such as a digital display, a TV monitor, an electronic-book reader, a portable web-browser (e.g., iPad™), and a computer monitor. It can also be an entertainment device, including a portable DVD player, conventional DVD player, Blue-Ray disk player, video game console, music player, such as a portable music player (e.g., iPod™), etc. It can also be a part of a device that provides control, such as controlling the streaming of images, videos, sounds (e.g., Apple TV™), or it can be a remote control for an electronic device. It can be a part of a computer or its accessories, such as the hard drive tower housing or casing, laptop housing, laptop keyboard, laptop track pad, desktop keyboard, mouse, and speaker. The article can also be applied to a device such as a watch or a clock.

Chemical Compositions

In one embodiment, the coating may be provided by, for example, depositing a precursor of a metamorphic transformable material on a surface and heating the precursor to a temperature and for a period of time to sufficiently adhere the precursor to the at least one surface of the substrate; and producing the coating formed of the metamorphic transformable material on the surface of a material.

Depending on the processes involved and the applications desired, the chemical composition of the alloy powder composition can be varied. For example, in one embodiment, the composition can have three phases, with one being a solid solution phase, and the two remaining phases being other component phases, e.g., a first component phase and a second component phase. The second component phase, for example, can be the same as or different from the first component phase in terms of chemical composition. In one embodiment, the second component phase includes at least one transition metal element and at least one nonmetal element, either of which elements can be the same as or different from those in the first component phase. The elements can also be present at any desirable amount. For example, in one embodiment, the transition metal element can be less than or equal to about 20 wt % of the overall alloy composition, such as less than or equal to about 15 wt %, such as less than or equal to about 10 wt %, such as less than or equal to about 5 wt %.

In one embodiment, the presently described powder composition is a part of a coating. The coating includes a powder composition having an alloy that is at least partially amorphous, and is a frictionally transformable alloy. In one embodiment, the alloy includes 40 to about 75 weight percent of a first component selected from the group consisting of iron, cobalt, and combinations thereof; more than about 20 weight percent of a second component selected from the group consisting of chromium, molybdenum, tungsten, niobium, vanadium, and combinations of chromium, molybdenum, tungsten, niobium, vanadium, and titanium; and from about 2 to about 6 weight percent of a third component selected from the group consisting of boron, carbon, and combinations thereof.

Particularly preferred frictionally transformable alloy compositions in this embodiment are shown in Table 3 below.

TABLE 3

Exemplary frictionally-transformable alloy compositions

| Alloy | Wt % | Wt % | Wt % | Wt % | Wt % |
|---|---|---|---|---|---|
| 1 | W | Cr | B | Fe | |
| | 49% | 8% | 3% | 40% | |
| 2 | Cr | V | Ti | C | Fe |
| | 9% | 11% | 5% | 4% | 71% |
| 3 | Cr | B | Fe | | |
| | 37% | 5% | 58% | | |
| 4 | Nb | B | Co | | |
| | 36% | 5% | 59% | | |
| 5 | Cr | C | Fe | | |
| | 37% | 5% | 58% | | |

In another embodiment, the metamorphic transformable material may include from about 20 to about 35 percent chromium, from about 2 to about 5 percent boron, from about 1 to about 2.5 percent silicon, from 0 to about 0.5 percent carbon, from about 0.5 to about 2 percent manganese, and from about 0.2 to about 1.0 percent titanium, balance iron and incidental impurities. Particularly preferred frictionally transformable alloy compositions in this embodiment are shown in Table 4 below.

TABLE 4

Exemplary frictionally-transformable alloy compositions

| | Element (wt. %) | | | | | | | |
|---|---|---|---|---|---|---|---|---|
| Alloy | Cr | B | Si | Mn | Ni | Mo | Cu | Ti |
| 1 | 27 | 3.7 | 1.8 | 1.6 | — | — | — | 0.84 |
| 2 | 22 | 2.3 | 2.0 | 0.7 | 5.3 | 3.7 | 2.0 | 0.49 |
| 3 | 28 | 3.8 | 1.8 | 1.6 | — | — | — | — |
| 4 | 23 | 2.3 | 1.0 | 1.2 | 8.0 | 3.7 | 2.0 | — |
| 5 | 25 | 4.1 | 1.2 | 1.2 | — | — | — | 2.5 |
| 6 | 22 | 2.6 | 2.0 | 0.5 | 4.6 | 4.2 | 2.3 | 3.0 |

In another embodiment, the frictionally transformable alloy includes chromium, molybdenum, carbon, boron, and iron. In one embodiment, the alloy composition consists essentially of chromium, molybdenum, carbon, boron, and iron. In one alternative embodiment, the alloy composition consists of chromium, molybdenum, carbon, boron, and iron. Depending on the application, the presently described alloy powder composition can be free of certain elements. For example, the composition can be free of nickel, aluminum, beryllium, silicon, or combinations thereof. The powder can be at least partially amorphous, such as at least substantially amorphous, such as completely amorphous.

The content of the elements in the alloy composition can vary. With respect to the element chromium, the alloy composition can include about 15 wt %, such as at least about 20 wt %, such as at least about 25 wt %, such as at least about 30 wt %, of Cr.

With respect to the element molybdenum, if used, the alloy composition can include at least about 10 wt %, such as at least about 15 wt %, such as at least about 20 wt %, such as such as at least about 25 wt %, of Mo.

With respect to the element carbon, the alloy composition can include at least about 0.5 wt %, such as at least about 1 wt %, such as at least about 2 wt %, such as such as at least about 3 wt %, of C. In one embodiment, the element C can be present in the form of a carbide.

With respect to the element boron, the alloy composition can include at least about 1 wt %, such as at least about 1.5 wt %, such as at least about 2 wt %, such as at least about 2.5 wt %, of C. In one embodiment, the element B can be present in the form of a boride.

The aforedescribed alloy compositions are balanced by iron. For example, in one embodiment, the alloy is represented by the formula: $(Cr_aMo_bC_cB_d)Fe_{100-(a+b+c+d)}$, wherein a, b, c, d each independently represents a weight percentage; and a is from about 22 to about 28, b is from about 14 to about 20, c is from about 2 to about 3, and d is from about 1.5 to about 2. In one exemplary embodiment, the alloy composition can be represented by the formula: $(Cr_{25}Mo_{17}C_{2.5}B_{2.0})Fe_{53.5}$.

In one embodiment, the alloy powder composition is at least partially substantially alloyed, such as at least substantially alloyed, such as fully alloyed. While not necessary, the presently described alloy composition preferably includes the elements in an alloy form, in contrast to a composite. The distinctions between an alloy and a composition have been provided elsewhere in this Specification. In particular, in some embodiments, it is preferred that the composition described herein is not in a composite form; instead, it is preferred that the powder alloy composition is in an alloy form. At least one advantage of having the elements (Cr, Mo, B, C, Fe, etc.) in an alloy form is that the composition can be homogeneous with respect to the chemical composition and not have any particular weak points at the interfaces of the different constituents as in the case of a composite. In the case of a composite, the composition could fall apart at an elevated temperature, particularly at the interface of different elements present as distinct entities or constituents with respect to their chemical or physical (e.g., mechanical) properties.

A composition including the alloy powder composition can consist essentially of the alloy powder composition, as the chemical composition can also contain some small amount of impurities. Alternatively, the composition can consist of the alloyed powder composition. The amount of impurities can be, for example, less than 10 wt %, such as less than 5 wt %, such as less than 2 wt %, such as less than 1 wt %, such as less than 0.5 wt %, such as less than 0.2 wt %, such as less than 0.1 wt %. In one embodiment, the chemical composition can consist of the alloy powder composition.

When the alloy powder composition is used to fabricate a product, such as a coating, additional materials can be optionally added. For example, in one embodiment wherein the alloyed powder is used to fabricate a coating on a substrate, some optional elements can be added in a small amount, such as less than 15 wt %, such as less than 10 wt %, such as less than 5 wt %. These elements can include, for example, cobalt, manganese, zirconium, tantalum, niobium, tungsten, yttrium, titanium, vanadium, hafnium, or combinations thereof. These elements, alone or in combination, can form compounds, such as carbides, to further improve wear and corrosion resistance.

Some other optional elements can be added to modify other properties of the fabricated coating. For example, elements such as phosphorous, germanium, arsenic, or combinations thereof, can be added to reduce the melting point of the composition. These elements can be added in a small amount, such as less than 10 wt %, such as less than 5 wt %, such as less than 2 wt %, such as less than 1 wt %, such as less than 0.5 wt %.

Method of Providing a Coating

The method of coating a coating a device with a transformable material includes depositing or coating a transformable material on at least one surface of a substrate, heating the substrate and transformable material to a temperature and for a period of time to sufficiently adhere the transformable material to the at least one surface of the substrate, and cooling the substrate and transformable material to room temperature at a rate sufficient to maintain the non-amorphous state of the transformable material. An embodiment of the method is illustrated in FIG. 5.

Figure 3:
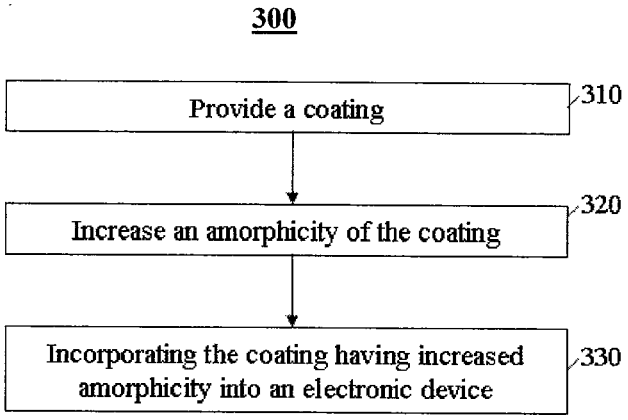
FIG. 3 depicts an exemplary method for processing a coating in accordance with various embodiments of the present teachings.

As shown in FIG. 5, the method 100 preferably includes three distinct processes, and the device, or substrate coated is processed in accordance with the arrows. The method 100 first includes depositing a metamorphic transformable material 130 onto a substrate 120 to form a coating 140. Any apparatus 110 can be used to perform the deposition, or coating, and specific apparatus 110 are illustrated in FIGS. 2-4 and described in more detail below.

The coating 140 preferably is applied using any method capable of depositing a powdered alloy composition onto a surface. Any suitable disposing techniques can be used. Suitable apparatus 110 include, for example, a high velocity thermal spraying process. For example, thermal spraying can be used. A thermal spraying technique can include cold spraying, detonation spraying, flame spraying, high-velocity oxy-fuel coating spraying (HVOF), plasma spraying, warm spraying, wire arc spraying, or combinations thereof. The wire arc spraying can be carried out by twin-wire arc spraying (TWAS). The thermal spray can be carried out in one or more steps of operation.

Once the coating has been applied, the coated substrate 120 then is subjected to a thermal treatment in which the coating 140 is heated to a temperature and for a period of time to sufficiently adhere the transformable material to the at least one surface of the substrate 120. Any apparatus 150 capable of providing radiation 155 suitable to heat the coating 140 can be used in the embodiments. It is known to bake coated steel to prevent hydrogen embrittlement, and any of the known methods of baking steel can be used in the embodiments, although for a completely different purpose.

For example, heating apparatus 150 can be an autoclave, industrial furnaces such as mesh belt type heat treatment furnaces, vacuum tube muffle furnace, electric arc furnace, batch ovens, blast furnaces, kilns, induction furnaces, refractory furnaces, conveyer belt furnace, reverberatory furnaces, and the like. Alternatively, heating apparatus may subject coating 140 to radiation 155 suitable to heat the surface of coating, such as ultrasonic radiation. In addition, substrate 120 and coating 140 may be heated in-line with a flame or electric heat source.

It is preferred in the embodiments that the substrate 120 and coating 140 be heated to a temperature slightly above the glass transition temperature but below the crystallization temperature of the frictionally transformable alloy used to form coating 140. The precise temperature will vary depending on the chemical make-up of the coating 140. Suitable heating temperatures may range from about 100° C. to about 600° C., preferably from about 150° C. to about 550° C., and most preferably from about 250° C. to about 400° C. Heating the frictionally transformable alloy after forming the coating allows the coating to partially coalesce, without harming the crystallinity or transformability of the material, and consequently fill in a substantial number of pores. Heating also provides a better seal between the surface of substrate 120 and coating 140. It is preferred that the substrate 120 and coating 140 be heated in apparatus 150 for a period of from about 10 minutes to about 2 hours, preferably from about 15 minutes to about 1 hour, and most preferably for about 30 minutes.

After the substrate 120 and coating 140 have been sufficiently heated, the material is cooled in cooling station 160. While FIG. 5 depicts a particular apparatus used to provide cooling 160, e.g., a quenching apparatus, cold air jet, cold gas or liquid jet and the like, it also is within the embodiments to allow substrate 120 and coating 140 to cool to ambient temperatures without a cooling apparatus 160. It is preferred, however, that the material be cooled in a controlled manner to maintain the frictionally amorphous characteristics of the coating. Using the guidelines provided herein, those skilled in the art will be capable of designing a suitable heating apparatus 150 and cooling apparatus 160 to sufficiently heat and then cool substrate 120 and coating 140, depending on the chemical make-up of the substrate 120 and coating 140.

After cooling, the device 170 is ready for further processing of the coating 140 to increase its amorphicity or to transform into an amorphous state, e.g., a hardened amorphous state, rendering the surface of the device harder (e.g., increasing the hardness of the surface) more capable of withstanding ordinary wear and tear. In certain cases, the surface of the device 170 may be frictionally transformed during normal use of the device, especially if device 170 is a hand held consumer electronics device that is placed in a holster or subjected to abrasive wear and tear.

The particular coating materials and various coating apparatus 110 will be described in more detail below.

In another embodiment, the substrate can be a bulk-solidifying amorphous alloy as described above. Accordingly, in one embodiment, the sprayed alloy coating can become a part of a hard-facing structure/material.

In one embodiment, the method can further include steps of making or providing the alloy powder composition. The composition can be any of the compositions provided herein. Various techniques can be used to fabricate the alloy powder composition. One such technique is atomization.

Atomization is one way of combining the coatings of the embodiments herein. One example of atomization can be gas atomization, which can refer to a method in which molten metal is broken up into smaller particles by a rapidly moving inert gas stream. The gas stream can include non-reactive gas(s), such as inert gases including argon or nitrogen. While the various constituents can be physically mixed or blended together before coating, in some embodiments, atomization, such as a gas atomization, is preferred.

In one embodiment, the method of coating or making a coating, can include providing a mixture; forming the mixture into a powder composition; and subsequently disposing the powder composition onto a substrate to form the coating. The composition can be any of the aforedescribed compositions. The mixture of the various elements, including chromium, tungsten, molybdenum, carbon, boron, and iron, can be pre-mixed, or they can be mixed in an additional step. The elements in the mixture can include any of the elements of the alloy powder composition. In one embodiment wherein the alloy composition produced is one that includes Cr, Mo, C, B, and Fe, the mixture can include the chromium, molybdenum, carbon, boron, and iron in their elemental form, alloy form, composite form, compound form, or a combination thereof. The mixture is substantially free of an amorphous phase or can contain some amorphous phase.

The step of forming can be carried out by atomization, as described above. The alloy powder composition can then be disposed onto a substrate. Any suitable disposing techniques can be used. For example, thermal spraying can be used. A thermal spraying technique can include cold spraying, detonation spraying, flame spraying, high-velocity oxy-fuel coating spraying (HVOF), plasma spraying, warm spraying, wire arc spraying, or combinations thereof. The wire arc spraying can be carried out by twin-wire arc spraying (TWAS). The thermal spray can be carried out in one or more steps of operation. Certain preferred coatings techniques will be described below in more detail with reference to FIGS. 2-4.

The presently described HVOF coatings can be dense with very low porosity (as aforedescribed) and/or little oxide inclusions and could be finished to low single digit room mean square ("Ra") values, which is an indicator of the smoothness of the layer. The TWAS coatings in accordance with the current invention also may be dense, low in oxide stringers, and show good alloying of the cored wire. TWAS coating also can be finished to low Ra values.

When used for thermal spraying, such as HVOF, the alloy thermal spray material preferably is fully alloyed. However, it need not be in an amorphous form, and even may have the ordinary macro-crystalline structure resulting from the normal cooling rates in the usual production procedures. Thus, the thermal spray powder may be made by such a standard method as atomizing from the melt and cooling the droplets under ambient conditions. The thermal spraying then melts the particles that quench on a surface being coated, providing a coating that may be substantially or entirely amorphous. By using the usual manufacturing procedures, the production of the thermal spray powder is kept relatively simple and costs are minimized.

Thermal spraying can refer to a coating process in which melted (or heated) materials are sprayed onto a surface. The "feedstock" (coating precursor) can be heated by, for example, electrical (plasma or arc) or chemical means (combustion flame). Thermal spraying can provide thick coatings (e.g., thickness range of about 20 micrometers or more, such as to the millimeter range) over a large area at a high deposition rate, as compared to other coating processes. The feedstock can be fed into the system in powder or wire form, heated to a molten or semi-molten state, and then accelerated towards substrates in the form of micrometer-size particles. Combustion or electrical arc discharge can be used as the source of energy for thermal spraying. Resulting coatings can be made by the accumulation of numerous sprayed particles. Because the surface may not heat up significantly, thermal spray coating can have an advantage of allowing the coating of flammable substances.

The composition can include any of the aforementioned alloy powder compositions. The disposing step can be carried out via any suitable techniques, such as spraying, such as thermal spraying. Thermal spraying process is generally referred to as a process that uses heat to deposit molten or semi-molten materials onto a substrate to protect the substrate from wear and corrosion. In a thermal spraying process the material to be deposited is supplied in a powder form, for example. Such powders could include small particles, e.g., between 100-mesh U.S. Standard screen size (149 microns) and about 2 microns.

The presently described alloy powder compositions can be used in a number of (fully or substantially fully) alloyed forms, such as cast, sintered, or welded forms, or as a quenched powder or ribbon. The composition can be especially suitable for application as a coating produced by thermal spraying. Any type of thermal spraying, such as plasma, flame, arc-plasma, arc and combustion, and High Velocity Oxy-Fuel (HVOF) spraying, can be used. In one embodiment, a high velocity thermal spraying process, such as HVOF, is used.

A thermal spraying process generally includes three distinctive steps: the first step is to melt the material, the second is to atomize the material, and the third is to deposit the material onto the substrate. For example, an arc spraying process uses an electrical arc to melt the material and a compressed gas to atomize and deposit the material onto a substrate.

Figure 6:
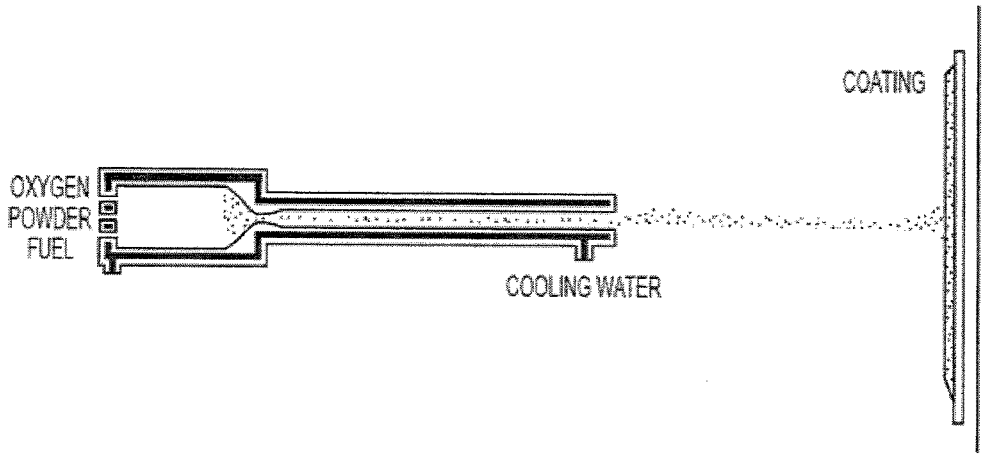
FIG. 6 shows a schematic diagram of an HVOF process for coating a transformable material into a substrate in accordance with various embodiments of the present teachings.

An embodiment of the HVOF process is shown in FIG. 6. The HVOF thermal spray process is substantially the same as the combustion powder spray process ("LVOF") except that this process has been developed to produce extremely high spray velocity. There are a number of HVOF guns that use different methods to achieve high velocity spraying. One method is basically a high pressure water cooled combustion chamber and a long nozzle. Fuel (kerosene, acetylene, propylene and hydrogen) and oxygen are fed into the chamber, combustion produces a hot high pressure flame which is forced down a nozzle increasing its velocity. Powder may be fed axially into the combustion chamber under high pressure or fed through the side of a laval type nozzle where the pressure is lower. Another method uses a simpler system of a high pressure combustion nozzle and air cap. Fuel gas (propane, propylene or hydrogen) and oxygen are supplied at high pressure, and combustion occurs outside the nozzle but within an air cap supplied with compressed air. The compressed air pinches and accelerates the flame and acts as a coolant for the gun. Powder is fed at high pressure axially from the center of the nozzle.

In HVOF, a mixture of gaseous or liquid fuel and oxygen is fed into a combustion chamber, where they are ignited and combusted continuously. The resultant hot gas at a pressure close to 1 MPa emanates through a converging-diverging nozzle and travels through a straight section. The fuels can be gases (hydrogen, methane, propane, propylene, acetylene, natural gas, etc.) or liquids (kerosene, etc.). The jet velocity at the exit of the barrel (>1000 m/s) exceeds the speed of sound. A powder feed stock is injected into the gas stream, which accelerates the powder up to 800 m/s. The stream of hot gas and powder is directed towards the surface to be coated. The powder partially melts in the stream, and deposits upon the substrate. The resulting coating has low porosity and high bond strength.

HVOF coatings may be as thick as 12 mm (½"). It is typically used to deposit wear and corrosion resistant coatings on materials, such as ceramic and metallic layers. Common powders include WC—Co, chromium carbide, MCrAlY, and alumina. The process has been most successful and can be used for depositing cermet materials (WC—Co, etc.) and other corrosion-resistant alloys (stainless steels, nickel-based alloys, aluminum, hydroxyapatite for medical implants, etc.).

Figure 7:
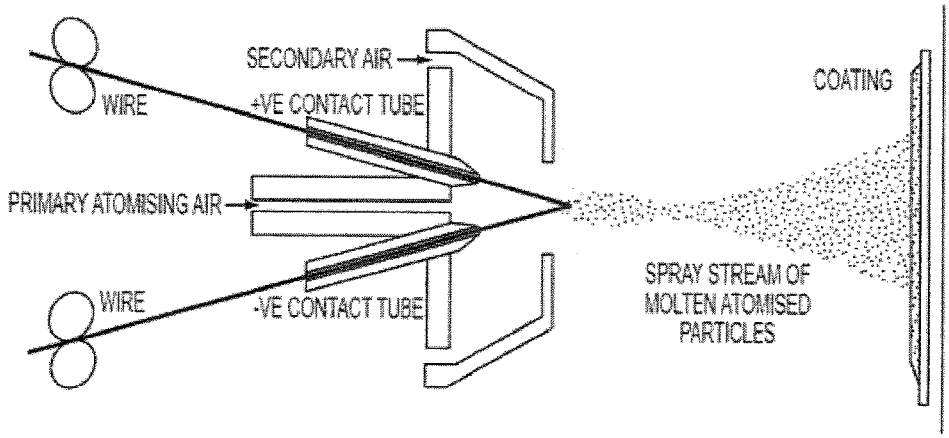
FIG. 7 shows a schematic diagram of an arc wire thermal spray process for coating a transformable material into a substrate in accordance with another embodiment.

Another method of making the coatings of the embodiments herein is by an arc wire thermal spray process shown in FIG. 7. In the arc spray process a pair of electrically conductive wires are melted by means of an electric arc. The molten material is atomized by compressed air and propelled towards the substrate surface. The impacting molten particles on the substrate rapidly solidify to form a coating. This process carried out correctly is called a "cold process" (relative to the substrate material being coated) as the substrate temperature can be kept low during processing to avoid damage, metallurgical changes and distortion to the substrate material.

Figure 8:
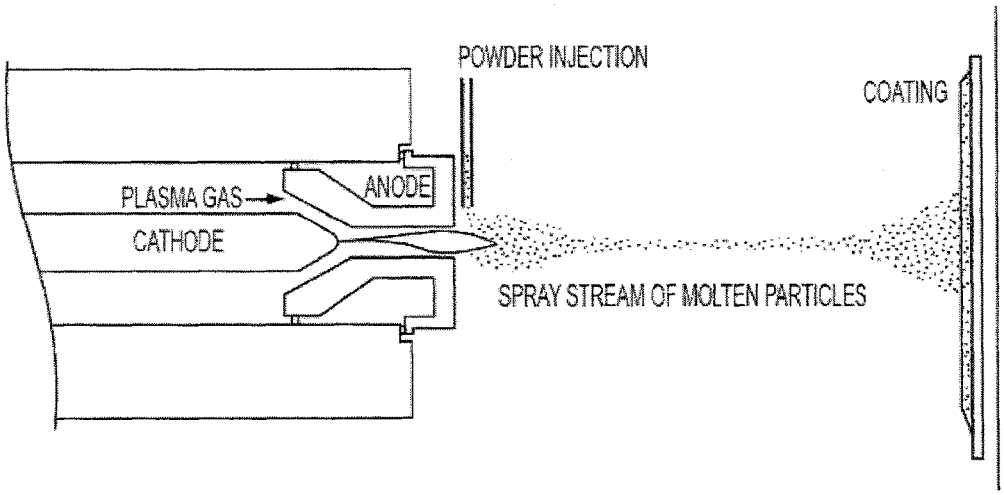
FIG. 8 shows a schematic diagram of a plasma thermal spray process for coating a transformable material into a substrate in accordance with another embodiment.

Another method of making the coatings of the embodiments herein can be by a plasma thermal spray process shown in FIG. 8. The plasma spray process substantially involves spraying molten or heat softened material onto a surface to provide a coating. Material in the form of powder is injected into a very high temperature plasma flame, where it is rapidly heated and accelerated to a high velocity. The hot material impacts on the substrate surface and rapidly cools forming a coating. This process carried out correctly is called a "cold process" (relative to the substrate material being coated) as the substrate temperature can be kept low during processing to avoid damage, metallurgical changes and distortion to the substrate material.

The plasma gun includes a copper anode and tungsten cathode, both of which are water cooled. Plasma gas (argon, nitrogen, hydrogen, helium) flows around the cathode and through the anode which is shaped as a constricting nozzle. The plasma is initiated by a high voltage discharge which causes localized ionization and a conductive path for a DC arc to form between the cathode and anode. The resistance heating from the arc causes the gas to reach extreme temperatures, dissociate, and ionize to form a plasma. The plasma exits the anode nozzle as a free or neutral plasma flame (plasma which does not carry an electric current) which is quite different from the plasma transferred arc coating process where the arc extends to the surface to be coated. When the plasma is stabilized and ready for spraying the electric arc extends down the nozzle, instead of shorting out to the nearest edge of the anode nozzle. This stretching of the arc is due to a thermal pinch effect. Cold gas around the surface of the water cooled anode nozzle being electrically non-conductive constricts the plasma arc, raising its temperature and velocity. Powder is fed into the plasma flame most commonly via an external powder port mounted near the anode nozzle exit. The powder is so rapidly heated and accelerated that spray distances can be in the order of 25 to 150 mm.

In one embodiment wherein the composition is used as a thermal spray material, the composition is desirably in an alloy form (as opposed to a composite of the constituents). Not to be bound to any particular theory, but desirable effects can be obtained during thermal spraying when the homogeneity of the sprayed composition is maximized—i.e., as an alloy, as opposed to a composite. In fact, alloyed powder of size and flowability suitable for thermal spraying can provide such a venue of homogeneity maximization. The powder particle can take any shape, such as spherical particles, elliptical particles, irregular shaped particles, or flakes, such as flat flakes. In one embodiment, the alloyed powder can have a particle size that falls in a range between 100-mesh (U.S. standard screen size—i.e., 149 microns) and about 2 microns. Furthermore, the thermal spray material may be used as is or, for example, as a powder blended with at least one other thermal spray powder, such as tungsten carbide.

In some embodiments, the presently described powder-containing alloy composition used as a part of thermal spray material can be fully alloyed, or at least substantially alloyed. Thus, the process can further include a step of pre-alloying and processing at least some of the alloy powder composition into a powder form prior to the step of disposing. The alloy powder composition need not be in an amorphous form. The composition, for example, can have at least some crystallinity, such as being fully crystalline, or can be at least partially amorphous, such as substantially amorphous or fully amorphous. Not to be bound by any particular theory, but some of crystallinity can arise from the normal cooling rates in the pre-existing alloyed powder production procedures. In other words, the thermal spray powder may be made by such standard methods as atomizing from the melt and cooling the droplets under ambient conditions, such as in air. In one embodiment, the alloyed powder can be manufactured by a method, such as atomization using non-reactive gases such as argon or nitrogen. Using such methods has been shown to develop secondary phases within the alloy. The thermal spraying can then melt the particles, which can quench on a surface being coated, thereby providing a coating that may be substantially or entirely amorphous.

Though composite wire coating and composite powder coating are two distinctly different technologies, it is worthwhile to mention U.S. Pat. No. 7,256,369. This patent discloses a composite wire in which the outer sheath may be constructed of any metal or alloy that is wrapped around a core of additional materials, including a cermet type material that does not alloy upon spraying. Such a method could also be used with the presently described alloy compositions.

During use, the powders may be sprayed in the conventional manner, using a powder-type thermal spray gun, though it is also possible to combine the same into the form of a composite wire or rod, using plastic or a similar binder, as for example, polyethylene or polyurethane, which decomposes in the heating zone of the gun. Alloy rods or wires may also be used in the wire thermal spray processes. The rods or wires should have conventional sizes and accuracy tolerances for flame spray wires and thus, for example, may vary in size between 6.4 mm and 20 gauge.

By using the manufacturing procedures disclosed herein, the production of the thermal spray alloyed powder can be kept relatively simple and costs minimized. The method described herein can have an advantage of being used to form a composite powder coating as an outer sheath around a core of additional materials, including a cermet type material that does not alloy upon spraying. During the process, the powder may be sprayed using a conventional technique, such as with a powder-type thermal spray gun. Alternatively, it is also possible to combine the same into a composite wire or rod using plastic or a similar binder, which can decompose in the heating zone of the gun. A binder can be, for example, polyethylene or polyurethane. Alloy rods or wires may also be used in the wire thermal spraying process. In one embodiment, the rods or wires can have sizes and accuracy tolerances for flame spray wires, and thus, for example, may vary in size between 6.4 mm and 20 gauges.

Although the compositions may be quite useful in a number of fully alloyed forms, such as, for example, cast, sintered, or welded forms, or as a quenched powder or ribbon or the like, it is especially suitable for application as a coating produced by thermal spraying. In such a thermal spray material, the composition should be in alloy form (as distinct from a composite of the constituents) since the desirable benefit is obtained with the maximum homogeneity available therefrom. Alloy powder of size and flowability suitable for thermal spraying is one such form. In a preferred embodiment, such powder may fall in the range between 100 mesh (U.S. standard screen size) (149 microns) and about 2 microns. For example, a coarse grade may be −140+325 mesh (−105+44 microns), and a fine grade may be −325 mesh (−44 microns)+15 microns. The thermal spray material may be used as is or, for example, as a powder blended with another thermal spray powder such as tungsten carbide.

One unexpected desirable property of one the preferred alloy composition that contains molybdenum is the unexpected increase in the thermal conductivity of the presently described alloy composition. Not to be bound by any particular theory, but the increase can be attributed to the presence of molybdenum, as compared to an alloy that does not have molybdenum or has a lower molybdenum content. It is noted that conventional hard-facing alloy material is frequently high in chromium but low in molybdenum, if any at all. In one embodiment, the presently described Mo-containing alloy has a thermal conductivity that is at least about 1%, such as at least about 2%, such as at least about 5%, such as at least about 6%, such as at least about 8%, such as at least about 10% higher than its non-Mo-containing (or lower-Mo-containing) counterparts. The thermal conductivity of the presently described composition can be at least 2 W/mk, such as at least 3 W/mk, such as at least 5 W/mk, such as at least 10 W/mk. In one embodiment, the preferred compositions have a thermal conductivity of between about 1 W/mk and about 10 W/mk, such as about 2 W/mk and about 6 W/mk, such as about 3 W/mk and about 5 W/mk, such as about 3.5 W/mk and about 4 W/mk. In one embodiment, the thermal conductivity is about 3.4 W/mk.

Also, not to be bound by any particular theory, but the increase in the thermal conductivity can result in an accelerated cooling of the alloy. One result of such expedited cooling can be an increase in amorphous phase of the alloy. In other words, the presence of Mo also surprisingly results in an increase in the content of the amorphous phase in the alloy. This can be particularly beneficial when the coating is frictionally transformed insofar as the transformation will bring about a greater amorphous nature of the coating, resulting in a harder, more corrosion resistant surface on the device.

Applications of Embodiments

The presently described processed materials provide significant improvements in wear resistance, surface activity, thermal conductivity, and corrosion resistance over other pre-existing, conventional, and/or non-processed coating. Because of the superior mechanical properties and resistance to corrosion, the presently described methods and materials can be used in a variety of devices. For example, the processed (e.g., transformed) coatings can be used as bearing and wear surfaces, particularly where there are corrosive conditions. The processed (e.g., transformed) coating can also be used, for example, for Yankee dryer rolls; automotive and diesel engine piston rings; pump components such as shafts, sleeves, seals, impellers, casing areas, plungers; Wankel engine components such as housing, end plate; and machine elements such as cylinder liners, pistons, valve stems and hydraulic rams. The coating is a part of a Yankee dryer, an engine piston; pump shaft, pump sleeve, pump seal, pump impeller, pump casing, pump plunger, component, Wankel engine, engine housing, engine end plate, industrial machine, machine cylinder liners, machine pistons, machine valve stems, machine hydraulic rams, or combinations thereof.

In embodiments, the processed coatings can be used on housings or other parts of an electronic device, such as, for example, a part of the housing or casing of the device or an electrical interconnector thereof. The disclosed methods can be used to manufacture portions of any consumer electronic device, such as cell phones, desktop computers, laptop computers, and/or portable music players. As used herein, an "electronic device" can refer to any electronic device, such as consumer electronic device. For example, it can be a telephone, such as a cell phone, and/or a land-line phone, or any communication device, such as a smart phone, including, for example an iPhone™, and an electronic email sending/receiving device. It can be a part of a display, such as a digital display, a TV monitor, an electronic-book reader, a portable web-browser (e.g., iPad™), and a computer monitor. It can also be an entertainment device, including a portable DVD player, DVD player, Blue-Ray disk player, video game console, music player, such as a portable music player (e.g., iPod™), etc. It can also be a part of a device that provides control, such as controlling the streaming of images, videos, sounds (e.g., Apple TV™), or it can be a remote control for an electronic device. It can be a part of a computer or its accessories, such as the hard driver tower housing or casing, laptop housing, laptop keyboard, laptop track pad, desktop keyboard, mouse, and speaker. The coating can also be applied to a device such as a watch or a clock.

While the invention has been described in detail with reference to particularly preferred embodiments, those skilled in the art will appreciate that various modifications may be made thereto without significantly departing from the spirit and scope of the invention.

What is claimed is:

1. An electronic device comprising:

one or more electronic device parts, each part having one or more surfaces; and a metamorphically transformed coating adhered to at least one surface of the one or more electronic device parts, wherein the metamorphically transformed coating has:

a first volume adjacent the at least one surface, comprising a crystalline phase metamorphically transformable to an amorphous phase, and having a first state of amorphicity;

a second volume adjacent the first volume and having a second state of amorphicity greater than the first state and resulting from a solid state change of the crystalline phase to an amorphous phase; and a third volume having a third state of amorphicity greater than the second state and resulting from an additional solid state change of the crystalline phase to amorphous phase, the third volume including an exterior surface of the metamorphically transformed coating.

2. The electronic device of claim 1, wherein the metamorphically transformed coating has a thickness of from about 0.005 to about 0.08 inches.

3. The electronic device of claim 1, wherein the metamorphically transformed coating has a porosity of less than 5 vol %.

4. The electronic device of claim 1, wherein the exterior surface of the metamorphically transformed coating has a Vickers hardness of at least about 800 HV-100 gm.

5. The electronic device of claim 1, wherein the metamorphically transformed coating comprises an alloy comprising: from about 40 to about 75 weight percent of a first component selected from the group consisting of iron, cobalt, and combinations thereof; more than about 20 weight percent of a second component selected from the group consisting of chromium, molybdenum, tungsten, niobium, vanadium, and combinations of chromium, molybdenum, tungsten, niobium, vanadium, and titanium; and from about 2 to about 6 weight percent of a third component selected from the group consisting of boron, carbon, and combinations thereof.

6. The electronic device of claim 1, wherein the metamorphically transformed coating comprises an alloy comprising: from about 20 to about 35 percent chromium; from about 2 to about 5 percent boron; from about 1 to about 2.5 percent silicon; from about 0 to about 0.5 percent carbon; from about 0.5 to about 2 percent manganese; from about 0.2 to about 1.0 percent titanium; and the balance iron and incidental impurities.

7. The electronic device of claim 1, wherein the electronic device is selected from the group consisting of a telephone, a cell phone, a land-line phone, a smart phone, an electronic email sending/receiving device, a television, an electronic-book reader, a portable web-browser, a computer monitor, a DVD player, a Blue-Ray disk player, a video game console, a music player, a device configured to control the streaming of images, videos, and sounds, a remote control, a watch, and a clock.

8. A device comprising:

a body having at least one surface;

a metamorphically transformed coating disposed on the at least one surface of the body, wherein the metamorphically transformed coating has:

a first volume comprising a crystalline phase metamorphically transformable to an amorphous phase by heating and having a first state of amorphicity;

a second volume having a second state of amorphicity greater than the first state of amorphicity; and a third volume defining an exterior surface of the device and having a third state of amorphicity greater than the second state of amorphicity and at least 80 volume percent amorphous phase;

wherein the second volume is between the first and third volumes of the metamorphically transformed coating.

9. The device of claim 8, wherein the metamorphically transformed coating has a thickness of from about 0.005 to about 0.08 inches.

10. The device of claim 8, wherein the exterior surface of the metamorphically transformed coating has a Vickers hardness of at least about 800 HV-100 gm.

11. The device of claim 8, wherein the metamorphically transformed coating has a thermal conductivity of at least about 3 W/mk.

12. The device of claim 8, wherein the metamorphically transformed coating comprises an alloy comprising:

from about 40 to about 75 weight percent of a first component selected from the group consisting of iron, cobalt, and combinations thereof; more than about 20 weight percent of a second component selected from the group consisting of chromium, molybdenum, tungsten, niobium, vanadium, and combinations of chromium, molybdenum, tungsten, niobium, vanadium, and titanium; and from about 2 to about 6 weight percent of a third component selected from the group consisting of boron, carbon, and combinations thereof.

13. The device of claim 8, wherein the metamorphically transformed coating comprises an alloy comprising:

from about 20 to about 35 percent chromium;

from about 2 to about 5 percent boron; from about 1 to about 2.5 percent silicon;

from about 0 to about 0.5 percent carbon; from about 0.5 to about 2 percent manganese;

from about 0.2 to about 1.0 percent titanium; and the balance iron and incidental impurities.

14. The device of claim 8, wherein the metamorphically transformed coating comprises an alloy represented by the formula $(Cr_aMo_bC_cB_d)Fe_{100-(a+b+c+d)}$ wherein a, b, c, d each independently represents a weight percentage, and wherein a is from about 22 to about 28, b is from about 14 to about 20, c is from about 2 to about 3, and d is from about 1.5 to about 2.

15. The electronic device of claim 4, wherein the metamorphically transformed coating is provided on wear surfaces of the electronic device.

16. A method for producing the electronic device according to claim 1, the method comprising:

inducing the solid state change in a portion of a coating adhered to the at least one surface of the one or more electronic device parts, the coating comprising the crystalline phase metamorphically transformable to the amorphous phase and having the first state of amorphicity, the portion being less than the entire coating, to produce the second state of amorphicity in the portion of the coating; and inducing the additional solid state change to produce the third volume of the portion at the exterior surface of the coating having the third state of amorphicity and the second volume of the portion retaining the second state of amorphicity, thereby producing the metamorphically transformed coating having at least three different states of amorphicity.

17. The method of claim 16, further comprising:

depositing a precursor of a metamorphically transformable material on the surface of the electronic device part; and heating the body and the precursor, thereby adhering the precursor to the surface of the electronic device part and producing the coating.

18. The method of claim 16, wherein inducing the solid state change comprises heating the coating.

19. The method of claim 18, wherein inducing the additional solid state change comprises at least one of grinding, polishing, lapping, or abrading the coating.

20. The method of claim 8, wherein the first volume has at least 20 volume percentage of the amorphous phase.

* * * * *